US009321231B2

(12) United States Patent
Strautmann

(10) Patent No.: US 9,321,231 B2
(45) Date of Patent: Apr. 26, 2016

(54) PRESS HAVING AT LEAST ONE COLLECTOR WAGON THAT CAN BE COUPLED AND UNCOUPLED

(75) Inventor: Wolfgang Strautmann, Bad Laer (DE)

(73) Assignee: SIB Ingenieurbuero GmbH, Glandorf (DE)

( * ) Notice: Subject to any disclaimer, the term of this patent is extended or adjusted under 35 U.S.C. 154(b) by 145 days.

(21) Appl. No.: 13/512,537

(22) PCT Filed: Nov. 29, 2010

(86) PCT No.: PCT/EP2010/068384

§ 371 (c)(1),
(2), (4) Date: May 29, 2012

(87) PCT Pub. No.: WO2011/064357

PCT Pub. Date: Jun. 3, 2011

(65) Prior Publication Data

US 2012/0234187 A1 Sep. 20, 2012

(30) Foreign Application Priority Data

| | | |
|---|---|---|
| Nov. 30, 2009 | (DE) | 10 2009 047 297 |
| Jan. 15, 2010 | (DE) | 10 2010 000 938 |
| Jul. 9, 2010 | (DE) | 10 2010 031 168 |

(51) Int. Cl.
*B30B 9/30* (2006.01)
*B30B 15/08* (2006.01)

(52) U.S. Cl.
CPC ..... *B30B 9/3042* (2013.01); *B30B 9/301* (2013.01); *B30B 9/3032* (2013.01); *B30B 9/3035* (2013.01); *B30B 15/08* (2013.01)

(58) Field of Classification Search
CPC .... B30B 9/3042; B30B 9/3032; B30B 9/301; B30B 9/3035; B30B 15/08
USPC ..... 100/7, 45, 94, 96, 97, 98 R, 100, 188 R, 100/215, 226, 227, 228, 246; 241/101.2, 241/222, 223, 224, 236
See application file for complete search history.

(56) References Cited

U.S. PATENT DOCUMENTS 3,058,320 A * 10/1962 Foster et al. ..... 62/382
3,189,286 A * 6/1965 O'Counor ..... 241/56

(Continued)

FOREIGN PATENT DOCUMENTS

| | | |
|---|---|---|
| JP | 2002126897 | 5/2002 |
| NL | 1011195 | 8/2000 |
| WO | 2008/113465 | 9/2008 |

*Primary Examiner* — Alexander P Taousakis
*Assistant Examiner* — Leonel Vasquez
(74) *Attorney, Agent, or Firm* — Greer, Burns & Crain Ltd.

(57) ABSTRACT

A press with at least one collector wagon for compressible material to be pressed that can be coupled and uncoupled and that comprises a collector chamber having floors and walls, as well as a press chamber. When the collector wagon is coupled to the press, the collected compressible material is mechanically transferred from the collector wagon into the press chamber, after movement of the floor and use of a feeder device. When uncoupled from the press, the collector wagon is filled with compressible material at a location at a distance from the press. The feeder device is designed such that the compressible material to be pressed present in the collector wagon, after the upward movement of at least the floor, is gradually gripped and continuously removed from the collector wagon from above, and fed to the press.

23 Claims, 27 Drawing Sheets

(56) References Cited

U.S. PATENT DOCUMENTS 3,754,500 A * 8/1973 Heth ..... 100/97
5,195,429 A * 3/1993 Firpo ..... 100/96
5,448,945 A * 9/1995 Taylor et al. ..... 100/100
6,468,019 B1 * 10/2002 Duval ..... 414/416.01
2007/0209529 A1 * 9/2007 Poss et al. ..... 100/43

* cited by examiner

PRESS HAVING AT LEAST ONE COLLECTOR WAGON THAT CAN BE COUPLED AND UNCOUPLED

BACKGROUND OF THE INVENTION

The instant invention relates to a press having at least one collector wagon for compressible material to be pressed that can be coupled and uncoupled, whereby the press encompasses a press chamber, whereby the collector wagon encompasses a collector chamber having a floor and walls, whereby, when the collector wagon is coupled to the press, compressible material collected therein can be mechanically transferred from the collector wagon into the press chamber, wherein at least the floor of the collector wagon can be displaced upward back and forth from a lower collecting position for emptying it, wherein provision is made for a feeder device, by means of which the compressible material present in the collector chamber can be fed upward to the press chamber of the press when the collector wagon is coupled to the press, by moving at least the floor, and wherein the collector wagon is fillable with compressible material to be pressed in a state uncoupled from the press at a location at a distance from the press.

In large shops, such as discount stores or large supermarkets, for example, the packaging material, which accumulates in response to the removal of merchandise from larger transport containers is generally collected in collector wagons as compressible material to be pressed, so as to then be guided therein towards a central press, in particular a baling press. Common collector wagons thereby have a base area, which corresponds approximately to the base area of a europallet. They are equipped with rollers and are pushed through the corridors of the sales room by the operating staff. On their sides, the collector wagons are typically provided with side walls as lateral boundary. Due to the fact that the loading of the collector wagons generally takes place from the top, the side walls encompass a height, which allows for this loading to take place effortlessly. When a collector wagon is filled, the operator drives with it to the central press, at which the content is unloaded from the collector wagon. This unloading of the compressible material collected in the collector wagon takes place either manually or machine-supported. In the case of a manual emptying, the material to be pressed is removed from the collector wagon by the operating staff, e.g., and is either filled into the storage chamber of a baling press, e.g. according to WO 2008/113465 A1, or the material to be pressed is inserted through the loading opening e.g. of a horizontal baling press into the press chamber thereof. When this press chamber has been filled to the extent that no further material to be pressed fits into it, the loading opening is closed and a pressing plate compacts the material to the pressed. This procedure is disadvantageously time-consuming and laborious.

Solutions for horizontal baling presses, in the case of which a collector wagon is placed into a lifting and tilting device assigned to the press, which are known from relevant practical experience, provide for a simplification and saving of time. After locking the collector wagon in the lifting and tilting device, the collector wagon is lifted by the device and is tilted about a horizontal axis by approx. 180°, whereby the content of the collector wagon falls into the storage container of the baling press or into the filling chamber of a press container. From this storage or filling chamber, the compressible material is then fed either into the press container or into the baling press with the help of suitable means, e.g. a compacting screw. The disadvantage of these solutions is in particular the space requirement for the lifting and tilting device and for the subsequent collector chamber. In addition, a high room, which is often not available, is required in the case of high-lying filling openings of presses for lifting and tilting the collector wagon by means of the device, so that such presses having a lifting and tilting device can then only be set up on open-air ground, where they are subject to weather conditions and which causes longer transport distances in response to the delivery of the compressible material to be pressed.

A press of the afore-mentioned type is known from document JP 2002-126 897 A. Material to be treated, which is collected in a collector wagon, is pressed by means of this press, in that the following steps are carried out successively: the collector wagon comprising the material to be treated is accommodated in a wagon storing chamber, a bottom plate of the collector wagon is lifted by means of a fork and the material to be treated is pressed out of the collector wagon into a carrier box and is prepressed. The carrier box, into which the prepressed material to be treated was pushed into, is then moved straight ahead sideways via a press chamber of the press, while the fork is lowered to a lower dead point position and the bottom plate is brought back to the bottom of the collector wagon. Finally, the prepressed material to be treated is pushed out of the carrier box into the press chamber, is pressed against the bottom of the press chamber and is pressed by means of a lowering operation of a pressing plate.

In the case of this known press, it is considered to be disadvantageous that only certain materials to be pressed are suitable for being transported by means of the carrier box, which must be open on the top and on the bottom, namely those materials, which jam in the transport box to a sufficient extent in response to the prepressing in the carrier box, without thereafter automatically falling out of the carrier box again in parts or even as a whole. Such a risk exists in particular in the case of flat layered compressible material, such as paper or cardboard boxes. The range of application of the press in terms of the compressible materials, which are to be processed, is thus limited.

SUMMARY OF THE INVENTION

The instant invention thus has the object of creating a press having at least one collector wagon that can be coupled and uncoupled, which avoids the afore-specified disadvantages and in the case of which a technically reliable, simple and operating staff-friendly insertion of different types of collected compressible material to be pressed into the press is ensured in response to a small space requirement, in particular in terms of the required height.

The solution of this object is successful according to the invention by means of a press of the afore-mentioned type, which is characterized in that the feeder device is embodied as a feeder, which captures the compressible material present in the collector wagon by moving at least the floor upward little by little and by continuously removing the compressible material from the collector wagon from above and by feeding the compressible material to the press.

According to the invention, the removal of the compressible material from the collector wagon takes place little by little from the top, for the purpose of which at least the bottom of the collector wagon is lifted continuously at the same time. The lifting of the bottom and the removal of the compressible material to be pressed by means of the feeder device are thereby perfectly matched to one another. A particularly high lifting of the collector wagon and a tilting about a horizontal axis or a laterally displaceable carrier box are no longer required in the case of the solution according to the invention.

The press according to the invention can thereby also be accommodated without any problems in spaces having a normal ceiling height. At least one collector wagon is assigned to the press; in practice, however, a plurality of collector wagons are advantageously assigned to the press in accordance with the demand of compressible material to be treated. Advantageously, the collector wagons are the same and can in each case be moved individually to the press for being emptied and can be coupled to the press.

A preferred embodiment of the press is characterized in that the feeder device is connected to the press or is embodied as part of the press. Due to its association to the press, the feeder device is only required once for each press, which is economically efficient. In the alternative, however, it is technically also possible that a corresponding feeder device is assigned to each collector wagon.

The feeder device can be embodied in a technically different manner. Preferably, the feeder device is embodied as a rotary cutter having a rotary grinder or having a plurality of parallel rotary grinders, which can be driven in the same direction by means of rotation, or as a drivable conveyor belt or conveyor chain arrangement, which is equipped with transport teeth, or as a screw conveyor, which consists of one or of a plurality of conveying screws, which can be driven by means of rotation.

When the feeder device is embodied as a rotary cutter having a plurality of parallel rotary grinders, which can be driven in the same direction by means of rotation, provision is then preferably to be made for the rotary grinders to be equipped with teeth and for the teeth of adjacent rotary grinders to be overlapping and horizontally offset relative to one another. A feeding effect, which is even and intensive across the surface of the collector wagon bottom, is obtained through this.

More preferably, the rotary grinders can thereby be driven at rotational speeds, which are different relative to one another, whereby a rotary grinder, which is located closest to the press chamber, has the highest rotational speed and a rotary grinder, which is located farthest away from the press chamber, has the lowest rotational speed. It is ensured through this that the compressible material, which is fed to the press chamber, is fed at an increasing speed towards the press chamber and is thus pulled apart. This ensures a safe and quick filling process and prevents an overloading or even a jamming of the rotary grinders, in particular of the rotary grinder or rotary grinders located closest to the press chamber. In the event that provision is made for a loading device between the feeder device and the press chamber, said loading device is also protected against an overloading or even a jamming.

In the case of this press, all of the rotary grinders can advantageously be driven by a common drive via gearbox elements, which are in each case translated differently relative to the drive. The drive can in each case be coupled to each rotary grinder via a gearbox element; in the alternative, the drive can be coupled, e.g., to the first or last rotary grinder and the gearbox elements of the further rotary grinders are then in each case coupled to the adjacent rotary grinder. Through this, a single motor, e.g. electric motor or hydraulic motor is then sufficient in any event to drive all of the rotary grinders, which then rotate during operating at fixed rotational speed ratios. In the alternative, provision can also be made for individual drives for the rotary grinders, which increases the technical effort, but which allows for a simple variation of the rotational speed ratios between the rotary grinders.

In the case of a collector wagon, which is coupled to the press, a preferred embodiment proposes for the bottom to be connected to a rear wall of the collector wagon facing away from the press to form an L-shaped bottom-wall element and for the bottom-wall element to be capable of being lifted and lowered relative to the remaining collector wagon. This embodiment has the advantage that the lifting device can be arranged above the space that the collector wagon, which is coupled to the press, assumes, whereby the lifting device can engage with the wall, which points upwards, for lifting the bottom-wall element.

As described above, a lifting of at least the bottom of the collector wagon is necessary for removing the compressible material to be pressed. To realize this lifting function, provision is preferably made at the press or at the feeder device for a lifting device, by means of which, when the collector wagon is coupled to the press, at least the bottom thereof or the bottom-wall element thereof can be lifted and lowered.

Advantageously, the lifting device, which, in response to the coupling of the collector wagon to the press, comes into direct or indirect engagement with the part of the collector wagon that can be lifted and lowered, is formed at the press or at the feeder device by means of at least one vertical revolving continuous traction mechanism, which can be driven in two directions. Due to its technical simplicity and reliability as well as space-saving design, the revolving continuous traction mechanism is very suitable as lifting device and can thus be used advantageously.

An embodiment of this press provides for the traction mechanism to be engaged with a lifting carriage, which is guided so as to be vertically displaceable on the press or the feeder device and which comes into engagement with the part of the collector wagon that can be lifted or lowered in response to the coupling of the collector wagon to the press. In the case of a suitable embodiment of its own construction and of its guide means, the lifting carriage ensures a safe and stable guiding of the part of the collector wagon that can be lifted and lowered during the transfer of the compressible material from the collector wagon into the press chamber of the press.

A further development to this effect proposes for the traction mechanism to be a roller chain, which is guided via two gear wheels, which are arranged vertically on top of one another on the press or the feeder device, at least one of which can be driven by means of rotation. The roller chain combines high resilience with good durability and low procurement costs, which contributes to a reliable and economical operation of the press.

So that the lifting device can reliably lift and lower the part of the collector wagon that can be lifted and lowered and so that the feeder device can reliably capture the compressible material collected in the collector wagon and transport it into the press chamber of the press, the collector wagon must be positioned accurately relative to the press and to the feeder device as well as to the lifting device. For this purpose, provision is preferably made at the press or at the feeder device thereof as well as at the collector wagon for coupling guides and locking bars, which engage with one another, as means for coupling the collector wagon to the press. The coupling guides ensure an accurate positioning of collector wagon and remaining press relative to one another. The locking bars ensure that the coupling state is maintained and can be adjusted either manually or by remote control.

A first preferred embodiment of the press to this effect is characterized in that the coupling guides are embodied as pairs of rails, which engage with one another, in the area of the upper edge of two walls of the collector wagon located opposite one another. In the case of this embodiment, an operator who couples the collector wagon to the press, can see the coupling guides well due to the arrangement thereof in the area of the upper edge of the walls of the collector wagon, so that the matching positioning of the coupling guides relative to one another is possible without any problems.

An alternative embodiment of the press to this effect proposed for provision to be made as means for coupling the collector wagon to the press for rollers guiding the guide rails of the collector wagon at the ground level of the set-up space of the press. In this embodiment, the rollers are spaced apart from the feeder device and the lifting device, so that they do not influence or hinder the technical design of the feeder device or lifting device. In this exemplary embodiment, an operator can also couple the collector wagon without any problems, in that he inserts the collector wagon running on its rollers into the guide rails. To facilitate the insertion of the rollers, the guide rails can be embodied with funnel-shaped inlet chamfers at their inlet area. For the coupling position of the collector wagon, the guide rails advantageously in each case encompass at least one stop, with which the leading roller collides in each case. In addition, provision can be made here for means for fixing the carriage in its coupling position.

So that residues of the compressible material do not remain in the collector wagon when the compressible material is removed from the collector wagon by means of the feeder device, provision is preferably made for the bottom of the collector wagon to be formed on its upper side in accordance with the contour of the feeder device facing the bottom. When the feeder device is formed from a plurality of parallel rotary grinders, for example, the bottom advantageously has the shape of curve sections, which are arranged and which run accordingly, at its supper side, which faces the feeder device.

Depending on the embodiment of the feeder device and on the type of compressible material to be pressed, it might happen that parts, for example teeth, of the feeder device pierce the compressible material. To ensure that the compressible material does not get caught on the feeder device, a scraper, which removes a compressible material from the feeder device, is advantageously assigned to the feeder device at its side, which faces the press.

The fact that the press preferably encompasses a loading opening on its rear side for mechanically transferring the compressible material from the collector wagon into the press chamber and that the press encompasses at its front side a door, which can be pivoted into an open position, for removing a pressed bale from the press chamber, contributes to a handling, which is favorable and safe for the operating staff. The removal of a pressed bale from the press can thus take place in a manner, which is known from common presses, which contributes to a safe operation of the press by the operating staff.

It is furthermore advantageous for provision to be made in the front side of the press above the door on in the upper part of the door for a further loading opening, through which compressible material can be manually filled into the press chamber. With this, is it advantageously attained that, by means of the further loading opening, as is known to the operating staff from common presses, the press can be filled manually from the front, in particular with small quantities and residual quantities of compressible material, for which the use of a collector wagon is not worthwhile. Advantageously, the further loading opening can optionally be locked and released by means of its own door or flap.

The press per se can be embodied differently. To obtain a particularly economical mode of operation of the press, it may be advantageous for an active loading device of the press to be arranged between the feeder device and the press chamber. The active loading device ensures that the compressible material to be pressed, which is removed from the collector wagon by means of the feeder device, is introduced into the press, in particular the press chamber thereof, under a certain precompression and by force. In the alternative, it is also possible for the feeder device itself to transport the compressible material to be pressed from the collector wagon into the interior of the press.

As an active loading device of the press, at least one rotor roller having transport teeth is thereby preferably arranged between the feeder device and the press chamber. For a reliable transport of the compressible material into the press chamber, the transport teeth can thereby cooperate with a slotted guide surface, into the slots of which the transport teeth can dip. In the alternative, provision can be made for two parallel rotor rollers, which rotate in opposite direction, between which the compressible material is fed.

A further embodiment of the press according to the invention is characterized in that the feeder device, the lifting device and the loading opening are in each case equipped with a power demand sensor and that a control unit is assigned to the press, to which measuring signals of the power demand sensor can be fed and by means of which the output of the feeder device, the lifting device and/or the loading device can be changed and/or the operating direction of which can be reversed in accordance with the fed measuring signals. In this manner, the control unit can react flexibly and as needed to certain operating situations, which could lead to interferences. When the power demand, e.g., of a drive, exceeds a certain limit, the output of the drive, in the case of which the threshold is exceeded, as well as of the preceding drives, if applicable, viewed in compressible material feeding direction, is reduced or they are even turned off and are reversed, if applicable. In the event that an excessive power demand is present only at the drive of the lifting device, e.g., only this drive is reversed. In the event that an excessive power demand is present at the drive of the rotary grinders, e.g., the drive of the lifting device is reversed and the drive of the rotary grinders is turned off and the loading device then initially keeps running on its own for a limited, predeterminable time period. The drive of the rotary grinders is then initially turned on again and the power demand thereof is measured. In the event that the power demand now lies below the threshold, the drive of the lifting device is also turned on again. In the event that an excessive power demand is present at the loading device, e.g., the drive of the lifting device as well as the drive of the rotary grinders is turned off or reversed. It is not only possible to reduce or turn off the power of the drive of the loading device, but it can also be reversed, if needed. After this, the drives are turned on again step by step. These circuits require for the drives of the mentioned aggregates, that is, of the loading device, the feeder device and the lifting device to either be driven via respective assigned drive aggregates or for the drives to be capable of being uncoupled from one another via corresponding technical means, such as adjustable couplings. However, operation is preferably carried out by means of independent drives. In this manner, looming overloads can be identified early on and matching countermeasures are initiated automatically. A reliable operation of the press is thus ensured and interferences or damages caused by overloads are prevented, even if the press is operated by personnel, which is not technically knowledgeable.

It is furthermore proposed for the press according to the invention for a pressing plate to be movable in the press chamber between a position above the rotor roller and a position below the rotor roller, for the transport teeth to reach into the movement area of the pressing plate and for the pressing plate to encompass passage slots for the transport teeth at its edge, which faces the rotor roller. The transport teeth of the loading device can thus reach further into the press chamber and can advantageously feed the compressible material to be fed into the press chamber in a better and more effective manner. Due to the passage slots in the edge of the pressing plate facing the rotor roller, the teeth, which stick through the movement area thereof, thus do not interfere in response to the press stroke and the return stroke of the pressing plate. The extension of the passage slots is thereby advantageously limited to such a measure that the pressing effect of the pressing plate and the mechanical stability thereof are not impacted by the passage slots.

A further embodiment of the press is characterized in that a bale ejector is arranged in the press chamber. The bale ejector can be adjusted to eject a pressed bale, which is ready pressed and which, if applicable, is bound, from a base position outside of the movement area of the transport teeth of the rotor roller into an ejection position in the movement area of the transport teeth of the rotor roller such that a rotational position sensor is assigned to the rotor roller and that the rotor roller can be stopped in a rotational position prior to an ejection of the pressed bale, in which its transport teeth assume a position, which is collision-free relative to the bale ejector. In the case of this press, the position of the transport teeth of the loading device in the turned-off state thereof can advantageously be chosen such that the bale ejector, in its movement plane, does not collide with the teeth of the loading device. For this purpose, the position of the rotor roller or the position of the teeth of the rotor roller, respectively, is queried and the stopping of the rotor roller then takes place in the suitable rotational position of the rotor roller, which is collision-free in terms of the bale ejector. The rotor roller can thus approach the press chamber as far as possible.

The press according to the invention having one or a plurality of corresponding collector wagons can be used advantageously, e.g., in large shops, such as discount stores or large supermarkets. The press according to the invention can also be used advantageously in industrial production sites, where residual material, which are to be collected and pressed, accumulate.

BRIEF DESCRIPTION OF THE DRAWINGS

Exemplary embodiments of the invention will be defined below by means of a drawing.

DESCRIPTION OF THE PREFERRED EMBODIMENTS

Figure 1:
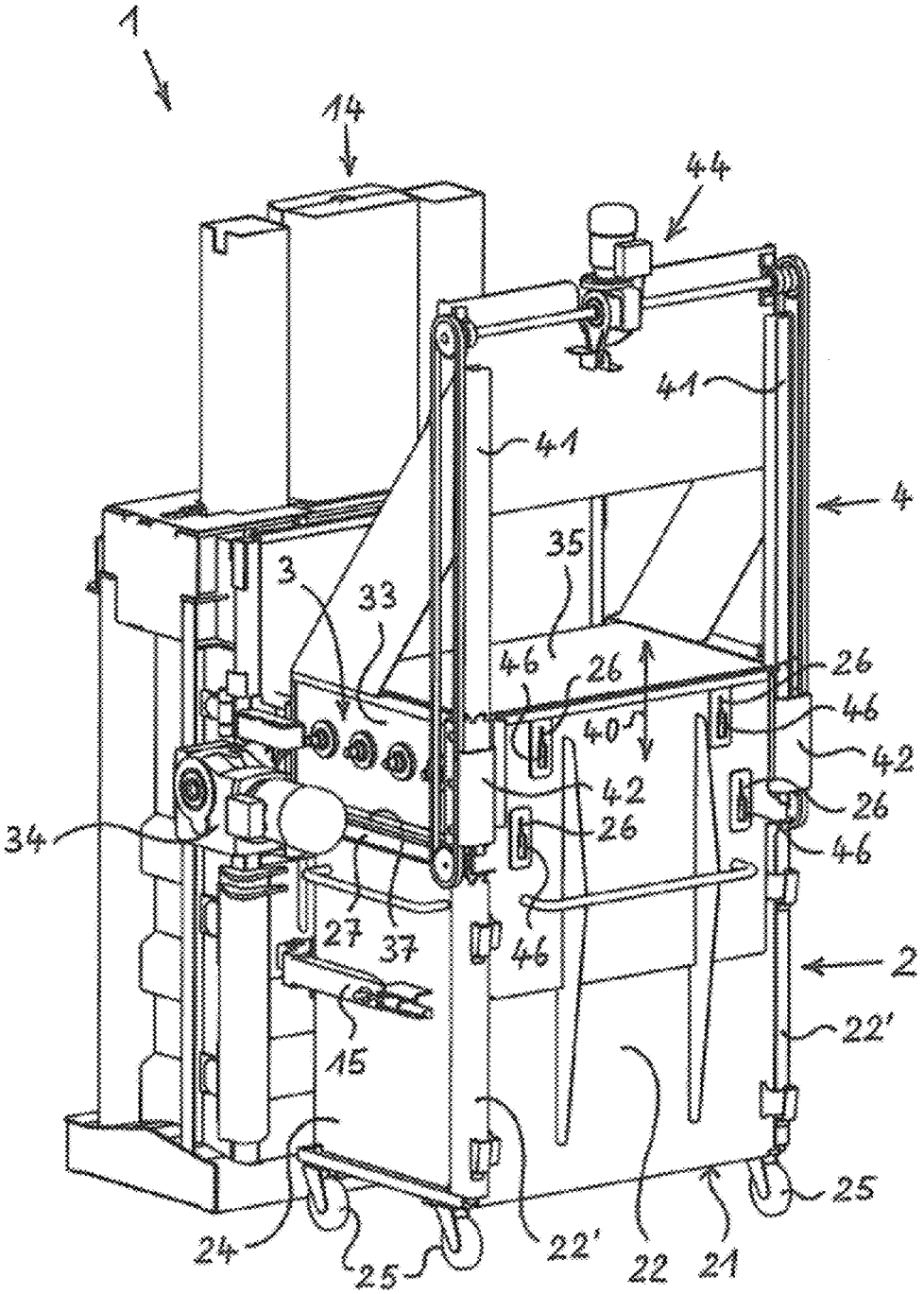
FIG. 1 shows a press having a coupled collector wagon and having a feeder device and a lifting device, in a perspective view.

FIG. 1 shows a press 1, embodied here as a bale press, together with a collector wagon 2, which is coupled to the front side thereof, in a perspective view. In its interior, the press 1 has a press chamber, in which a pressing plate, which is not visible here, can be displaced up and down by means of a power drive 14.

Compressible material to be pressed is initially collected in the collector wagon 2 or in a plurality of collector wagons 2 at one location or at a plurality of locations located at a distance from the stationary press 1. When the collector wagon or a collector wagon 2, respectively, is filled, the operating staff brings it to the press 1 and couples it thereto. Two pairs of rail-like coupling guides 27, 37, which are in each case provided on the left and on the right of the upper edge of two side walls 24 as well as on two side flanges 33 of a feeder device 3, which is positioned above the collector wagon 2, serve for a positionally accurate coupling. The coupling engagement is established in that the collector wagon 2 is moved with its coupling guides 27 into the coupling guides 37 of the feeder device 3. The collector wagon 2 is fixed in its coupled position by means of two locking bars 15, which engage with the side walls 24 of the collector wagon 2 on the left and on the right and which are connected to the front side of the press 1, which faces the collector wagon 2.

The feeder device 3 is connected here to the press 1 and forms a part of the press 1. Four rotary grinders, which run parallel to one another and which can be driven by means of rotation, which will be described below, are located under a cover 35, which is visible in FIG. 1. The drive 34, which is visible on the left in FIG. 1, here an electric motor having an angular gear, serves to drive the feeder device 3.

In addition, a lifting device 4, which is arranged above the feeder device 3 and which, like the feeder device, is connected to the press 1 via the feeder device 3, furthermore belongs to the press 1 according to FIG. 1. The lifting device 4 comprises a lifting frame 41, in which a lifting carriage 42 can be displaced vertically upwards in the direction 40 as well as vice versa. An electric motor, which is arranged on the lifting device 4 on the top and which comprises an angular gear and a shaft, via which two v-belts or chains are guided so as to run vertically, parallel to the lifting frame 41 on the left and on the right, serves as drive 44 for the lifting device 4. The lifting carriage 42 is connected to said v-belts or chains for its vertical adjustment. In FIG. 1, the lifting carriage 42 is covered for the most part by the rear wall 22 of the collector wagon 2, which extends upwards. On its side, which faces the observer, the lifting carriage 42 has a plurality of hooks 46, here four, which engage with correspondingly positioned accommodations 26 in the rear wall 22 when the collector wagon 2 is coupled to the press 1.

In the example according to FIG. 1, the rear wall 22 and a bottom 21 of the collector wagon 2, which is not visible in FIG. 1, are combined to form a bottom-wall element 21, 22, which can be moved in two rear wall guides 22' in vertical direction relative to the remaining collector wagon 2.

By activating the drive 44 of the lifting device 4 and by simultaneously activating the drive 34 of the feeder device 3, the wall-bottom element 21, 22 is moved upwards, whereby compressible material located in the collector wagon 2 is simultaneously removed from the top by means of the feeder device 3 and is fed into the press 1 in a feeding direction, which runs substantially horizontally.

Rollers 25, which can be embodied as fixed rollers and guide rollers, for example, and which are attached to the bottom side of the collector wagon 2, serve to easily transport the latter.

Figure 2:
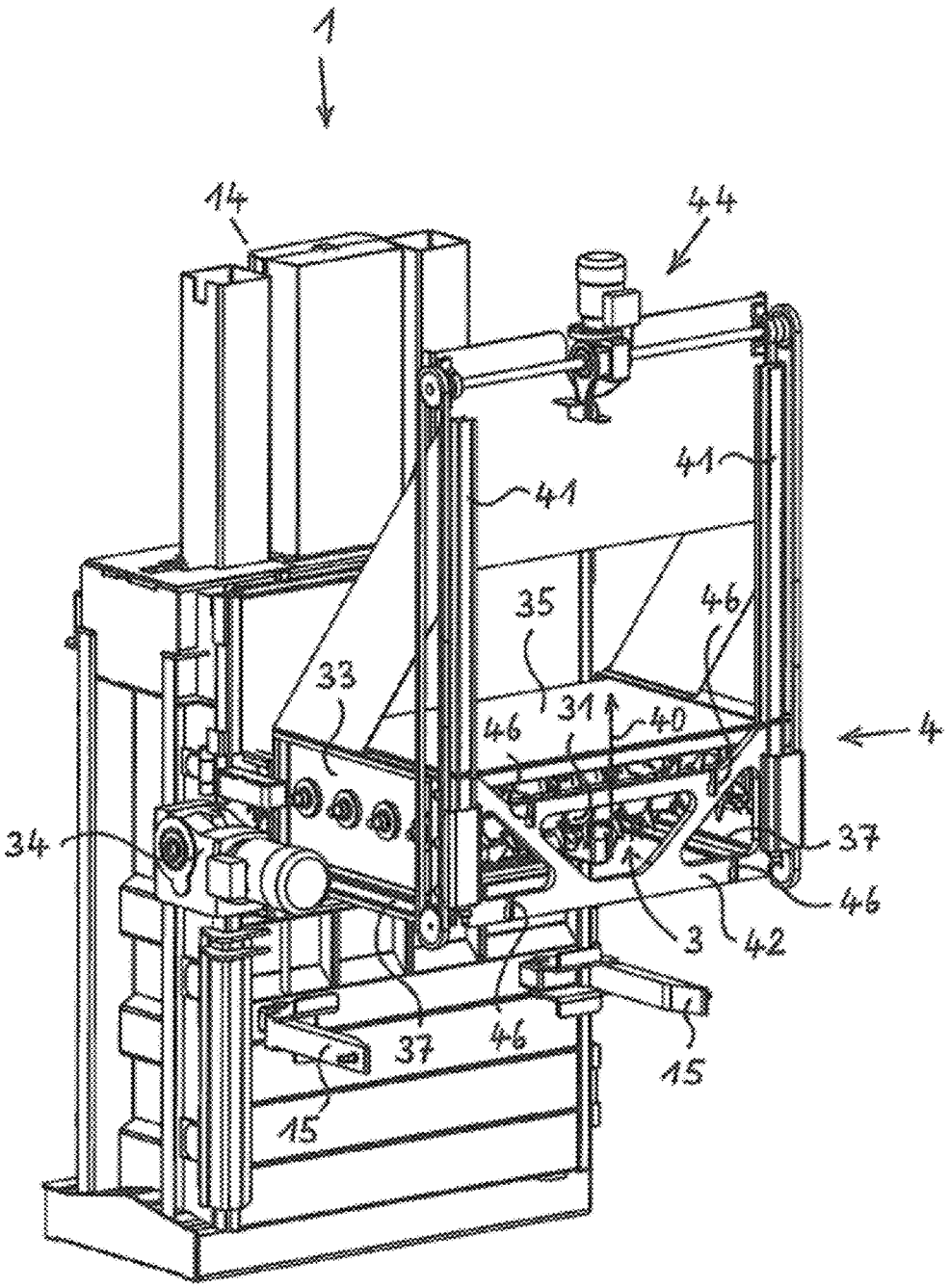
FIG. 2 shows the press from FIG. 1 having the feeder device and lifting device, but without collector wagon, in the same view as in FIG. 1.

FIG. 2 of the drawing shows the press 1 having the feeder device 3 and the lifting device 4 in the same view as in FIG. 1, but now without collector wagon. The feeder device 3 together with the lifting device 4 can again be seen on the side of the press 1, which faces the observer.

The feeder device 3 consists of the two side flanges 33, in which a total of four rotary grinders 31 having horizontal axes of rotation, which run parallel to one another, are supported here. The rotary grinders 31 can be made to rotate by means of the drive 34. On their outer periphery, the rotary grinders 31 in each case encompass a plurality of teeth or spikes, by means of which compressible material located in the collector wagon 2 can be captured and can be fed in the direction of the press 1. The rail-shaped coupling guides 37 for coupling to the collector wagon 2 are visible on the left and right of the bottom edge of the two side flanges 33.

The lifting device 4 consists of the lifting frame 41, which is formed by means of the two vertical lateral rails, which run parallel to one another. The lifting carriage 42 can be displaced in lifting direction 40 on the lifting frame 41. On the side, which faces the observer, the lifting carriage 42 carries the four hooks 46 for coupling to the rear wall of the collector wagon.

The two locking bars 15, which serve to fix a coupled collector wagon, are visible below the feeder device 3 on the press 1. The power drive 14 for the pressing plate, which can be vertically displaced in the interior of the press 1, can be seen on the top of the press 1.

Figure 3:
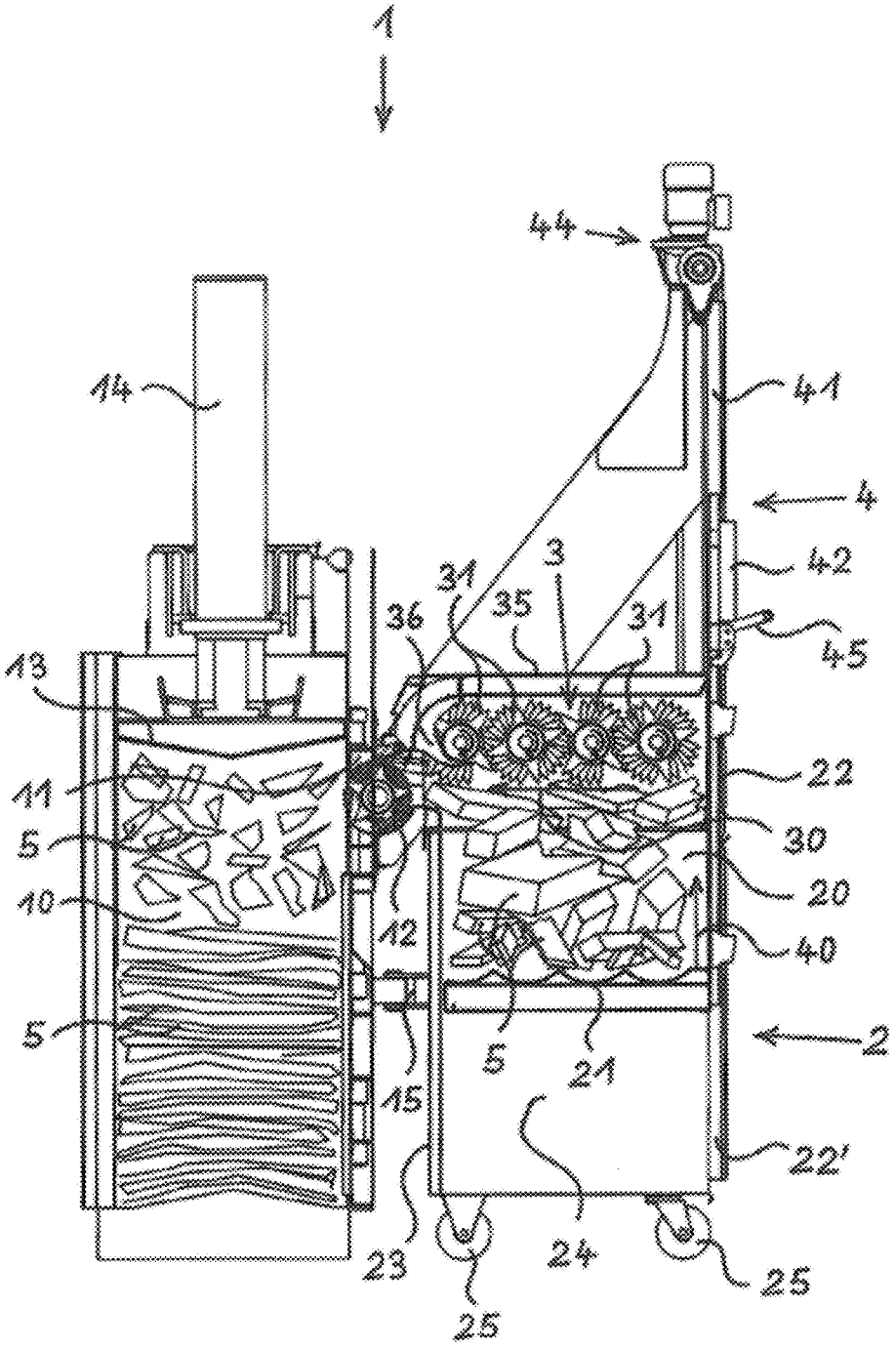
FIG. 3 shows the press having the feeder device, lifting device and collector wagon from FIG. 1, in longitudinal section.

FIG. 3 shows the press 1 having collector wagon 2, feeder device 3 and lifting device 4 from FIG. 1 in a vertical longitudinal section. The collector wagon 2 is fixed here relative to the press 1 via the locking bars 15 and via the coupling guides, which are not visible here. The bottom-wall element 21, 22 is engaged with the lifting device 4, not via the afore-described hooks and accommodations for it here, but, as a technical alternative, via a folding lever 45, which is manually adjustable.

In the state illustrated in FIG. 3, the bottom 21 of the collector wagon 2 is already lifted upwards to a certain extent in the direction of the lifting arrow 40 by means of the lifting device 4. At the same time, the compressible material 5, which is collected in the collector wagon 2 in the collector chamber 20 thereof, is removed from the collector wagon 2 from the top and is fed to the press 1 in feeding direction 30 by means of the feeder device 3, which is in operation, with its four parallel rotary grinders, which rotate in the same direction in terms of the spinning arrows, which are marked thereon.

The teeth of the rotary grinders 31 are arranged such that the teeth of adjacent rotary grinders are horizontally offset and overlap one another. For this purpose, the teeth of adjacent rotary grinders 31 are arranged so as to be offset relative to one another viewed in longitudinal rotary grinder direction. The advantage of this arrangement is that, except for the last rotary grinder 31 in feeding direction 30, scrapers are not required to scrape off compressible material 5 adhering to the teeth when the teeth rotate upwards again, because the teeth of the next rotary grinder 31 in feeding direction 30, which arrive from the top, take over this scraping. The horizontal offset of the teeth cannot be seen in FIG. 3, but the overlapping radii are visible.

Here, the press 1 has an active loading device 12 in the form of a rotor roller, which can be driven by means of rotation. The individual pieces of the compressible material 5 are transferred from the feeder device 3 to the loading device 12, which feeds the compressible material 5 into the press chamber 10 of the press 1 by means of a movement component, which is oriented diagonally downwards. A part of the compressible material 5, which has already been pressed, is illustrated in the lower part of the press chamber 10. A press stroke of the pressing plate 13 is in each case carried out by means of the power drive 14 when the press chamber 10 is filled with compressible material 5 to be pressed. Downstream from the press stroke, the compressible material 5, as is illustrated in the lower part of the press chamber 10, is compressed and new compressible material 5, which has not yet been compressed, can again be introduced into the upper area of the press chamber 10. In this manner, the compressible material 5 to be pressed, which has been collected in the collector wagon 2, is transferred and compressed fully automatically without any manual intervention and without much expenditure of time from the collector chamber 20 of the collector wagon 2 via the feeder device 3 and the loading device 12 into the press 1, in particular into compact and bound or wrapped pressed bales.

It can also be seen in FIG. 3 that on its upper side, the bottom 21 of the collector wagon 2 encompasses a contour, which is adapted to the contour of the side of the feeder device 3, which points downwards. A complete removal of the compressible material 5 from the collector chamber 20 of the collector wagon 2 is ensured in this manner.

After a complete emptying of the collector wagon 2, the feeder device 3 is brought to a standstill and the bottom-wall element 21, 22 is lowered downwards into the lowest position again by rerouting the lifting device 4. In this position, the bottom 21 is in its collecting position, in which the collector wagon 2 can be used for collecting compressible material 5 to be pressed. After releasing the locking bars 15, the collector wagon 2 according to FIG. 3 can be moved away from the press 1 to the right below the feeder device 3 and the lifting device 4 and can then be brought back to a collection location for compressible material, which is located at a distance from the press 1.

Figure 4:
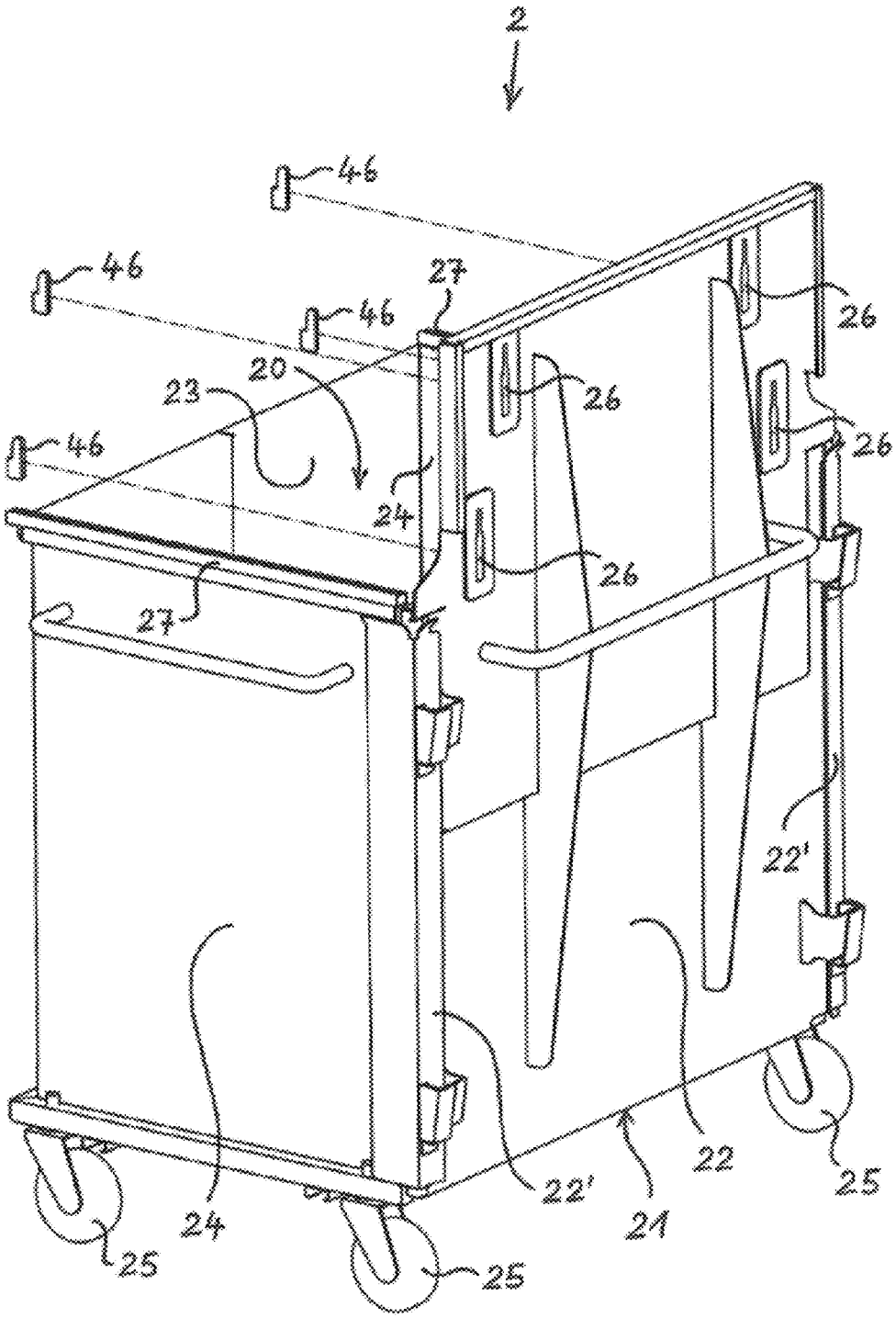
FIG. 4 shows the collector wagon on its own, in perspective view, diagonally from behind.

A collector wagon 2 is illustrated by itself in a perspective view diagonally from behind in FIG. 4 of the drawing. The bottom 21, which is not visible here, and the rear wall 22 form the bottom-wall element 21, 22, which is connected to one another and which can be displaced vertically as a unit in the rear wall guides 22'. The four accommodations 26 are visible in the upper part of the rear wall 22 for accommodating the hooks 46 of the lifting device, which are only suggested as individual parts here. The collector wagon 2 is defined towards its sides by the two side walls 24, which form a fixed part of the collector wagon 2. Towards the front, the collector wagon 2 is defined by the front wall 23. The coupling guides 27 run along the upper edge of the two side walls 24 in each case in the form of a rail. On its bottom side, the collector wagon 2 has the rollers 25 for easily moving and displacing the collector wagon 2 between collection locations and press 1.

Figure 5:
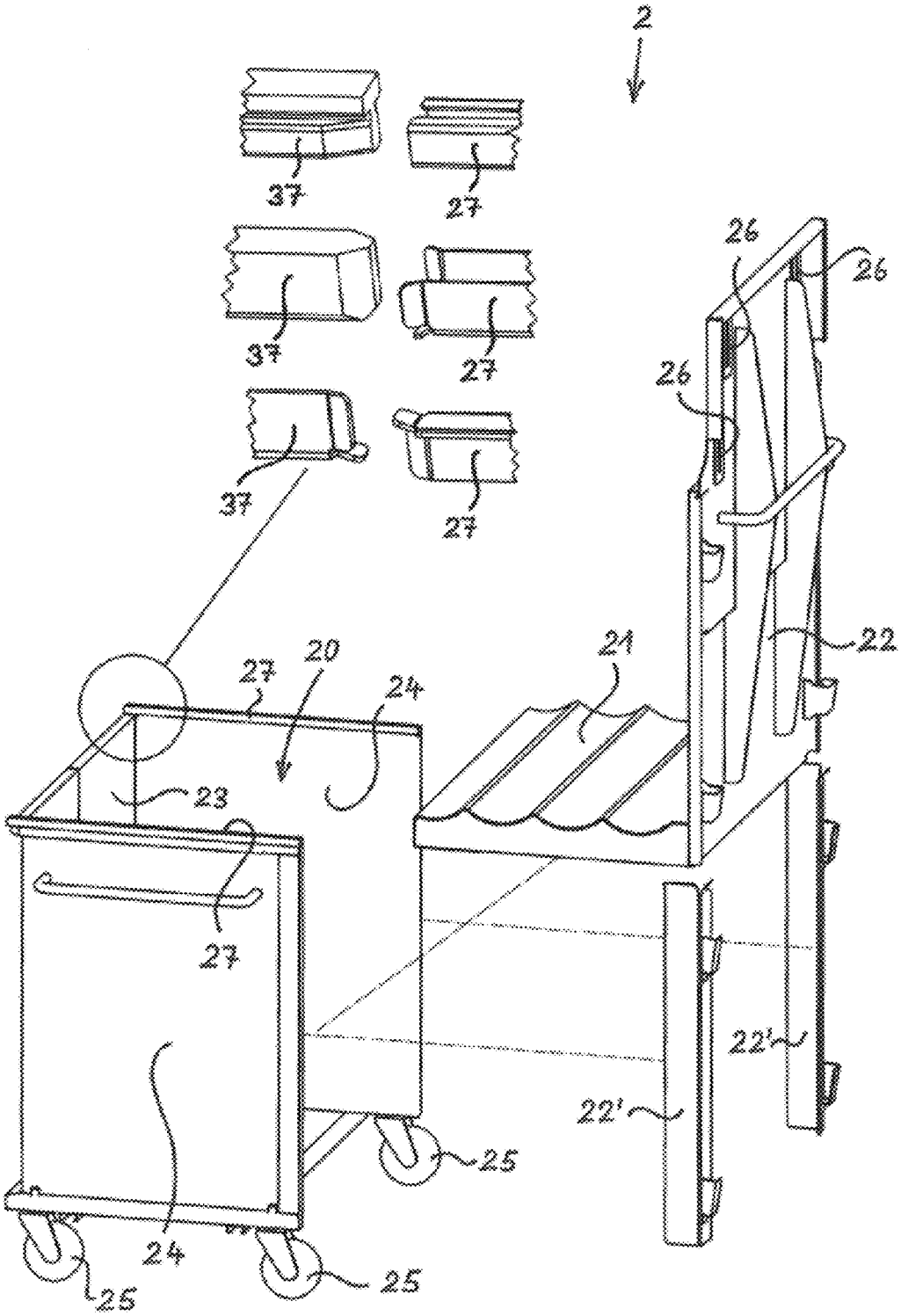
FIG. 5 shows the collector wagon from FIG. 4, in a perspective individual illustration.

In FIG. 5, the collector wagon 2 is illustrated as being disassembled into its individual parts, whereby the two side walls 24 and the front wall 23 having the bottom-side rollers 25, which together form a structural unit, are visible in FIG. 5. The bottom 21 and the rear wall 22 of the collector wagon 2 connected thereto are illustrated on the right in FIG. 5. The two lateral rear wall guides 22' are shown below the bottom 21. The bottom 21 has a width and depth, which correspond to the surface between the side walls 24 and the front wall 23 in consideration of a sufficient mobility. It is ensured with this that all of the compressible material 5, which is located in the collector chamber 20, is taken along upwards when the bottom 21 is lifted, without being able to jam in a space between the lateral edges and the front edge of the bottom 21 on the one hand and between the side walls 24 and the front wall 23 on the other hand.

The rail-shaped coupling guides 27 are attached on the top of the edges of the two side walls 24. These coupling guides 27 and the coupling guides 37, which interact therewith on the side of the feeder device 3, can be embodied differently, as is suggested by means of a plurality of examples at the top left in FIG. 5. Advantageously, all of the illustrated examples of the interacting coupling guides 27 and 37 are embodied such that they are embodied with centering inlet chamfers, so as to facilitate the coupling of the collector wagon 2 to the press 1 or to the feeder device 3 thereof, respectively.

Figure 6:
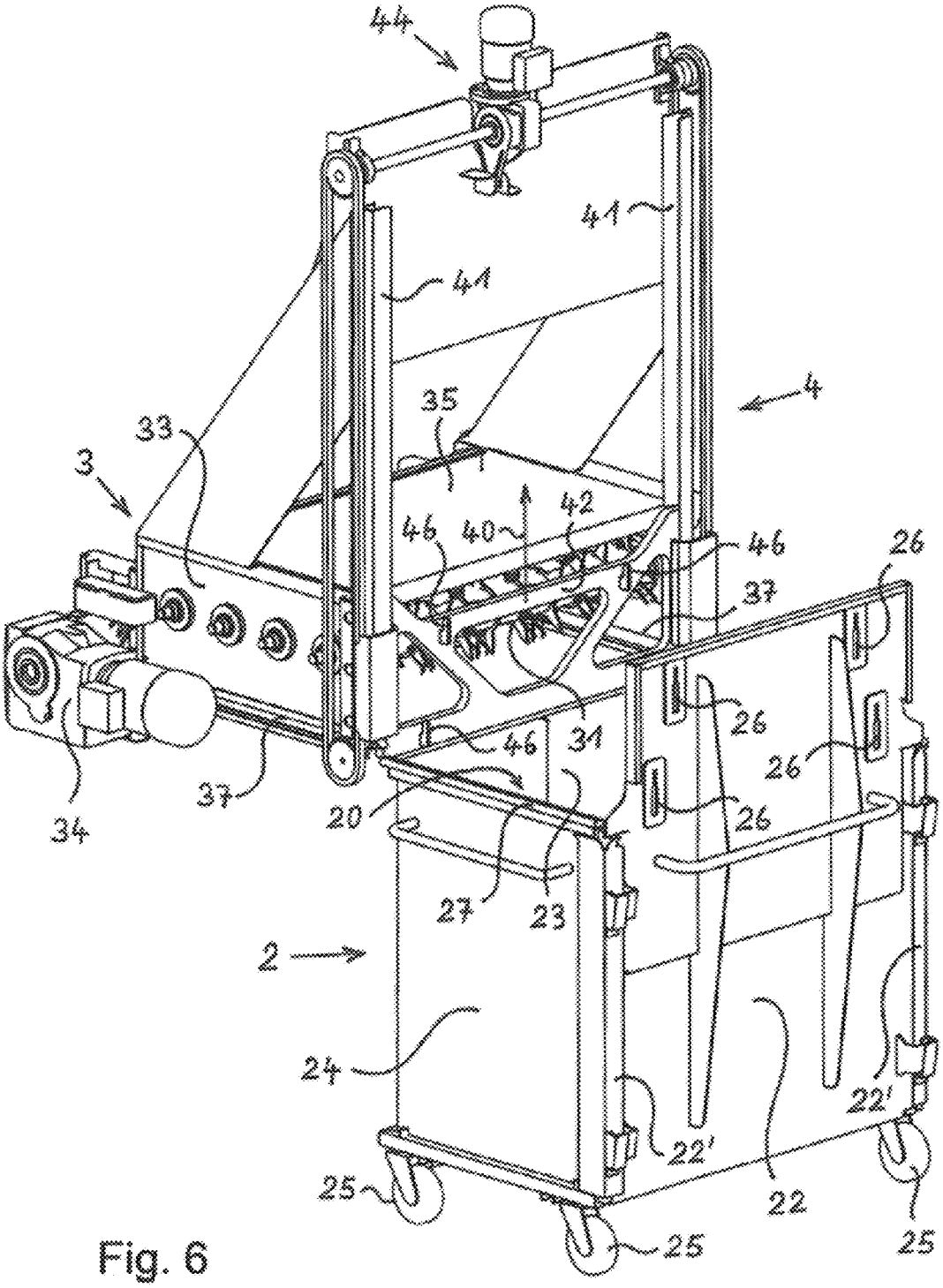
FIG. 6 shows the feeder device and the lifting device from FIGS. 1 and 2 together with a collector wagon, which has not yet been coupled, in perspective view.

The feeder device 3 and the lifting device 4 are illustrated without the press in FIG. 6, but together with a collector wagon 2, which is to be coupled.

The feeder device 3 corresponds to the afore-described embodiment; reference is made to the preceding description. The same applies for the lifting device 4.

The collector wagon 2 also corresponds to the afore-described embodiment. In FIG. 6, the collector wagon 2 is located in a position immediately prior to the coupling to the feeder device 3 or press, respectively. For this purpose, the coupling guides 27 on the side of the collector wagon 2 are juxtaposed with the coupling guides 37 on the bottom side of the feeder device 3. From this position, the collector wagon 2 can be pushed forward, whereby the coupling guides 27 and 37 become engaged with one another. The collector wagon 2 is then fixed after a closing of the locking bars, which are not illustrated here.

Figure 7:
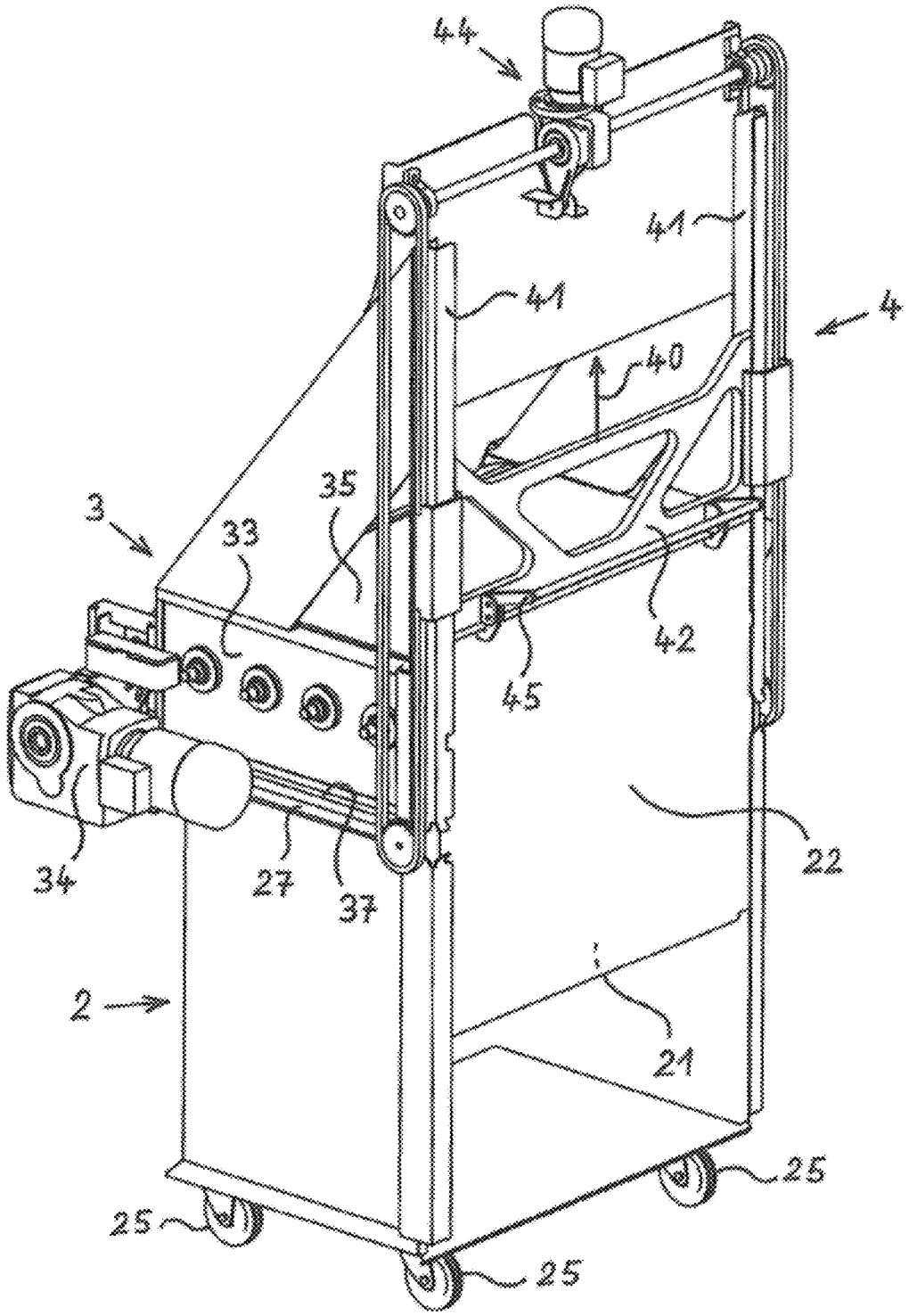
FIG. 7 shows the feeder device and lifting device from FIG. 6 with coupled collector wagon, in the same perspective view as in FIG. 6.

The state when the collector wagon 2 is coupled is shown in FIG. 7. The coupling guides 27 and 37 are now completely engaged with one another. At the same time, the lifting carriage 42 is also engaged with the rear wall 22 of the collector wagon 2, here by means of the folding lever 45. The bottom 21 together with the rear wall 22 of the collector wagon 2 is lifted in the direction of the lifting arrow 40 by means of the lifting device 4, whereby the compressible material to be pressed, which is located in the collector wagon 2 and which is not visible here, is captured little by little by the feeder device 3 and is removed continuously from the top and is fed to the press.

Figure 8:
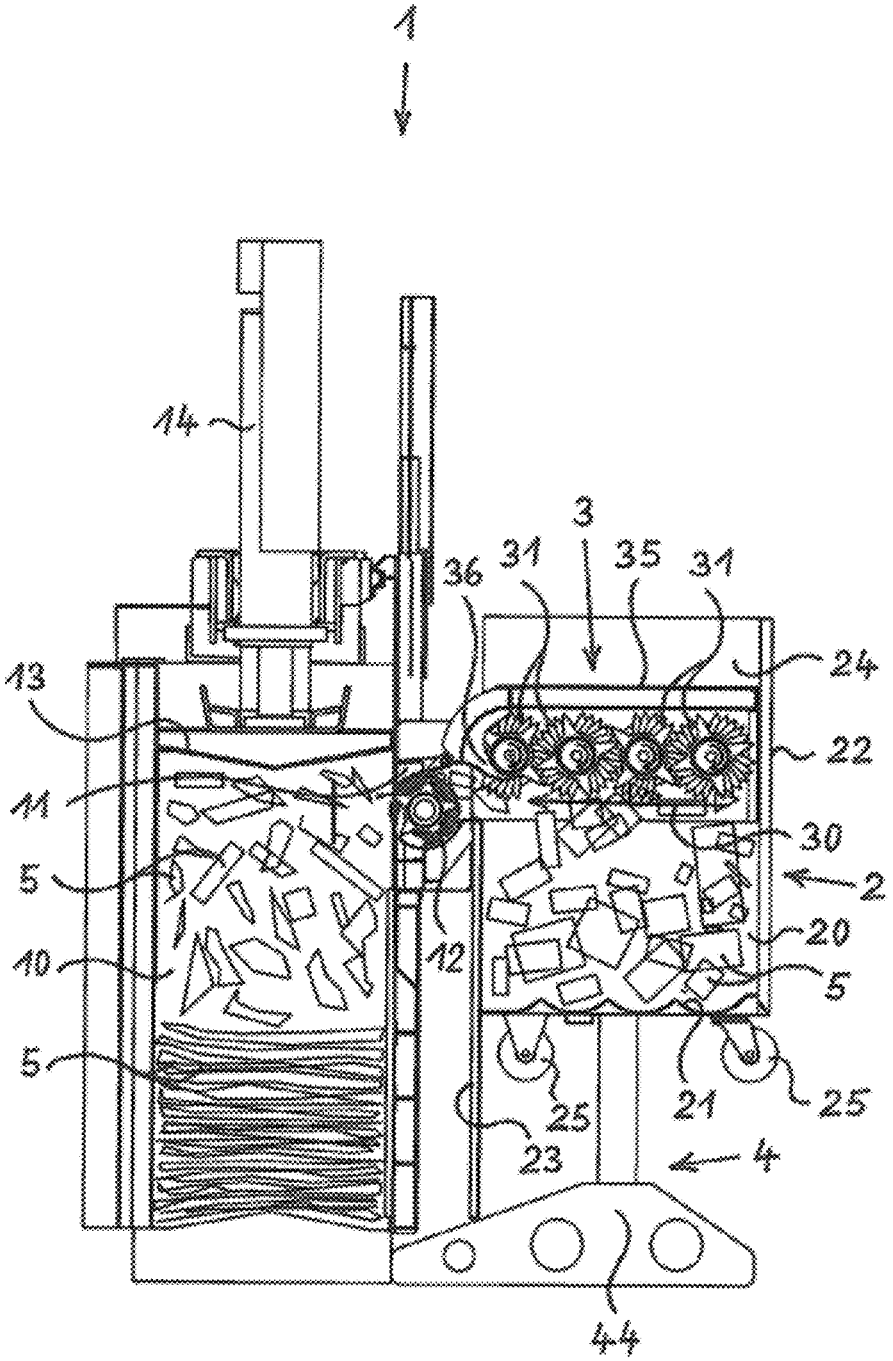
FIG. 8 shows the press in an embodiment with a changed lifting device in longitudinal section

FIG. 8 shows a changed embodiment of the invention in particular having a changed lifting device 4. In the case of the lifting device 4 shown here, the latter is located below the collector wagon 2 and lifts the collector wagon 2 as a whole by means of an assigned lifting drive 44.

The feeder device 3 thereby substantially corresponds to the afore-described embodiment. It is to be noted in the case of the embodiment according to FIG. 8 that the feeder device 3 has width and depth dimensions such that it fits into the collector chamber 20 of the collector wagon 2 and that the collector wagon 2 can then still be moved vertically relative to the feeder device 3. In addition, it must be noted here that the front wall 23 is embodied such that it does not impact the transfer of the compressible material 5 from the collector chamber 20 of the collector wagon 2 in feeding direction 30 to the press 1 when the collector wagon 2 is lifted. In the shown example, the front wall 23 is embodied for this purpose as a wall, which can be displaced vertically relative to the remaining collector wagon 2 and which does not perform the lifting movement of the collector wagon 2 when the latter is lifted, and is thus displaced downwards relative to the remaining collector wagon 2. The upper edge of the front wall 23 thus always remains at a level, which is so low that the transfer of the compressible material 5 can be carried out without interferences. In the alternative, the front wall 23 can also be embodied as hinged or foldable or rollable wall.

Incidentally, the press 1 shown in FIG. 8 corresponds to the embodiment, which has already been described in FIG. 3.

Figure 9:
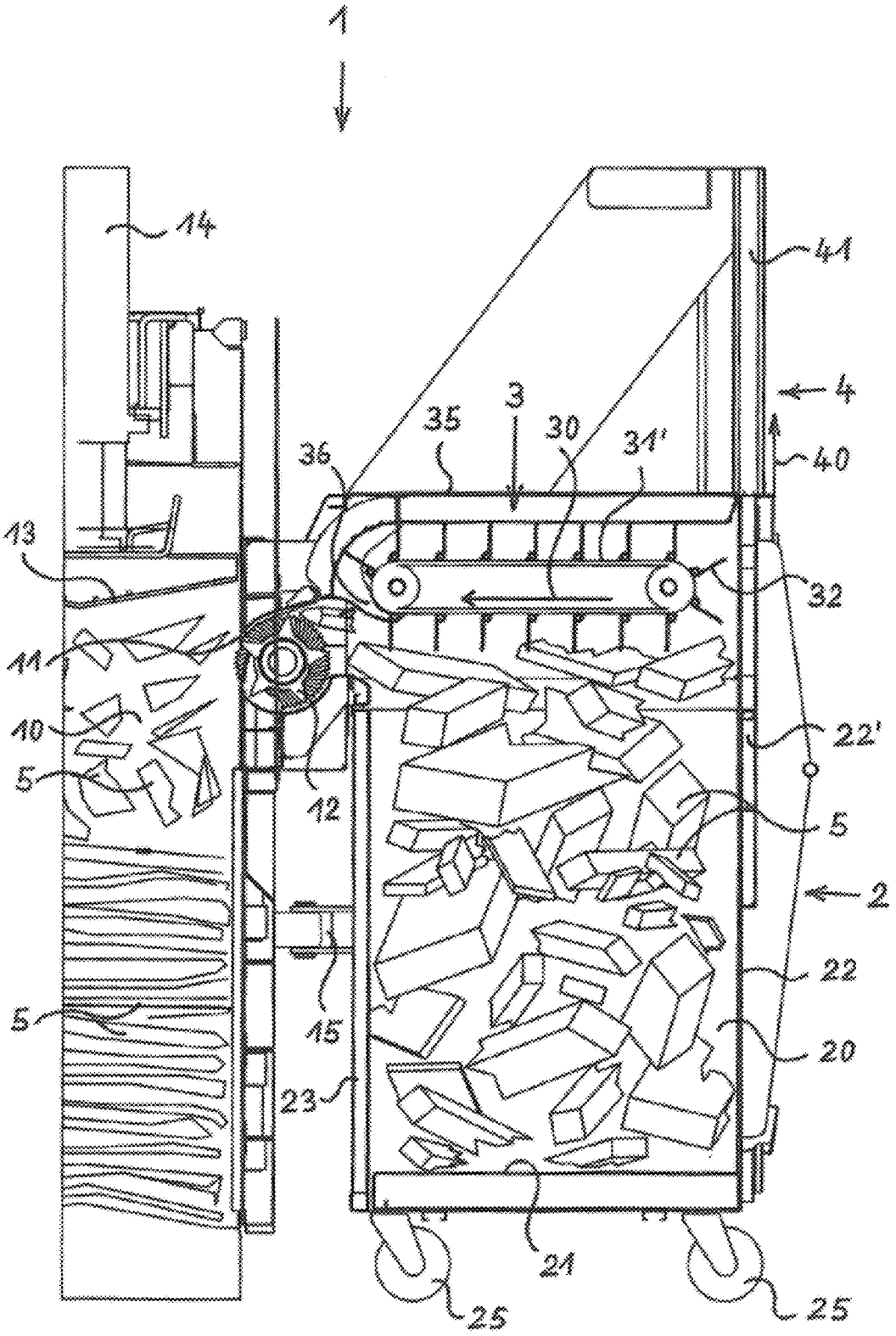
FIG. 9 shows a section of the press having a changed feeder device, in longitudinal section.

FIG. 9 shows an embodiment of the invention having a changed feeder device 3. In contrast to the afore-described examples, the feeder device 3 is formed here by means of a revolving conveyor belt 31', which is equipped with resilient teeth 32. By means of a drive, which is not visible here, the conveyor belt 31' can be made to move in terms of the feeding direction 30. Compressible material 5, which is located in the collector chamber 20 of the collector wagon 2, can thus also be removed from the top by means of this feeder device 3 and can be transferred into the press chamber 10 of the press 1, only a section of which is illustrated here, via a loading device 12, which is also provided here. A conveyor belt 31', the width of which corresponds to the width of the collector chamber 20, can thereby be used, or provision can be made for a plurality of narrower conveyor belts 31' next to one another.

Here, the lifting device 4 corresponds to the embodiment according to the afore-described FIGS. 1 to 3 as well as 6 and 7.

Figure 10:
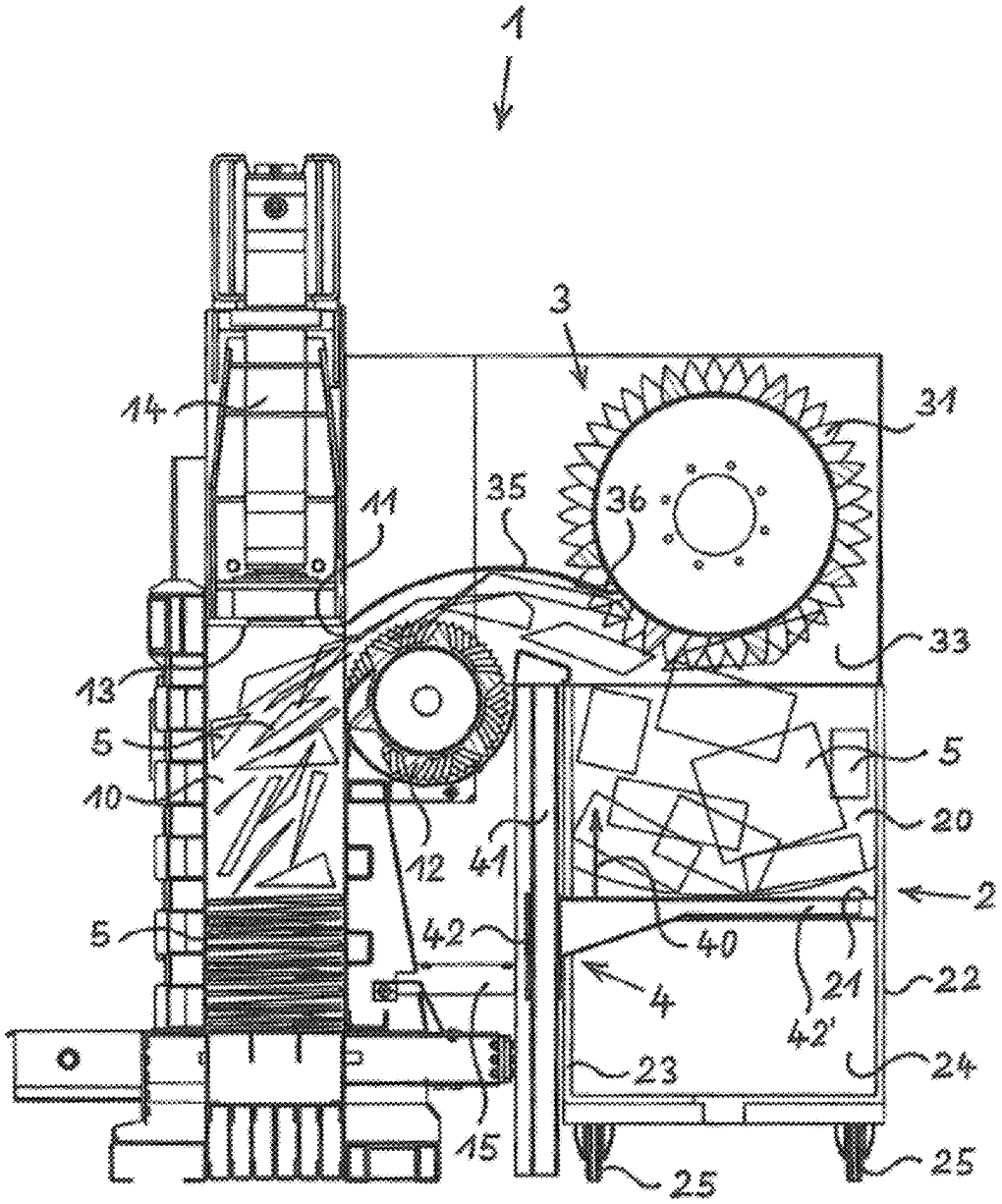
FIG. 10 shows the press in a further embodiment having a changed feeder device and a changed lifting device, in longitudinal section.

A further embodiment of the invention is shown in FIG. 10. The press 1 is embodied here as a so-called disk press, in which relatively narrow partial pressed bales are initially created, whereby they obtain a particularly high press density. A complete pressed bale is then formed from a plurality of these partial pressed bales by means of binding them together.

The feeder device 3, which is embodied here from a single rotary grinder 31 having a relatively large diameter of approximately the horizontal depth of the collector chamber 20 in the collector wagon 2, also differs from the preceding examples. The compressible material 5 captured by the rotary grinder 31 is removed little by little from the collector wagon 2 from the top and is fed to the loading device 12 of the press 1 underneath a cover 35, which is at the same time embodied as a scraper 36.

In the example according to FIG. 10, the lifting device 4 is also shown in a further embodiment. The lifting device 4 is located here below the feeder device 3 between the press 1 and the collector wagon 2. The bottom 21 of the collector wagon 2 is guided so as to be displaceable in vertical direction. To displace the bottom 21 in the direction of the lifting arrow 40, a single lifting arm 42' or an arrangement of a plurality of lifting arms 42' projects through one or a plurality of narrow slots in the front wall 23, which are arranged to fit, into the collector wagon 2 and below the bottom 21. The lifting arms 42' are attached to a lifting carriage 42, which can be displaced vertically directly in front of the front wall 23 of the collector wagon 2 at a lifting frame 41, which is connected to the press 1 and to the feeder device 3.

Coupling guides, which are not visible in FIG. 10, as well as two locking bars 15, which are attached between the press 1 in the collector wagon 2, also advantageously take over the fixation of the collector wagon 2 relative to the press 1 here.

Figure 11:
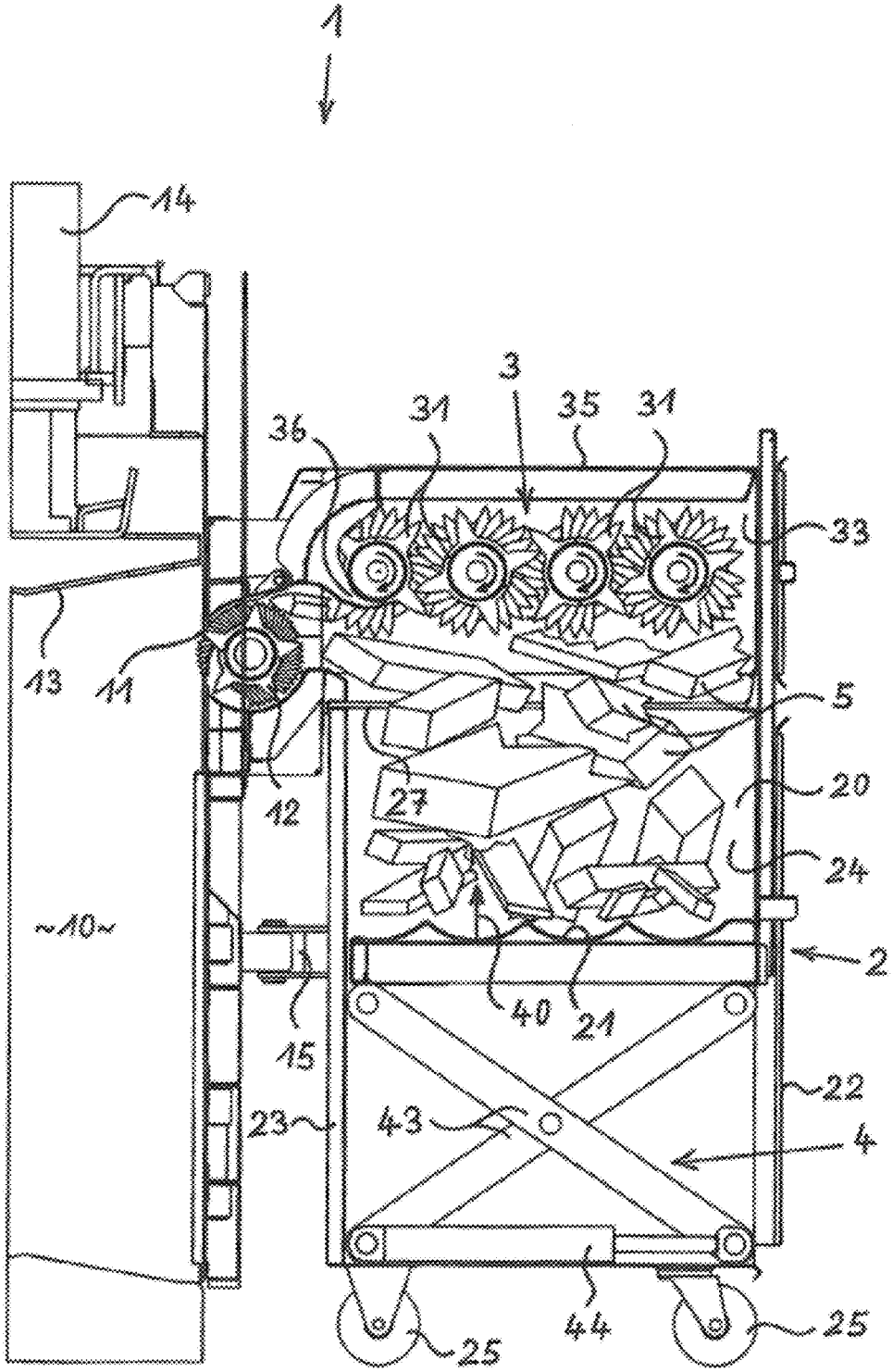
FIG. 11 shows the press in a further embodiment having a lifting device in the collector wagon, in longitudinal section.

FIG. 11 shows an embodiment of the invention, in the case of which the lifting device 4 is integrated in the collector wagon 2. The bottom 21 of the collector wagon 2 is guided so as to be vertically movable in the collector chamber 20 thereof, whereby a scissor-type lifting arrangement 43 is arranged below the bottom 21 of the collector wagon 2 within the latter for this purpose. A lifting drive 44 in the form of a pneumatic or hydraulic piston-cylinder unit serves to adjust the scissor-type lifting arrangement 43. In this arrangement, all of the walls 22, 23 and 24 of the collector wagon 2 can be arranged so as to be fixed. One of the coupling guides 27, which is provided on the side of the collector wagon 2 and which engages with a corresponding coupling guide, which is not visible in FIG. 11, of the feeder device 3, can be seen at the upper edge of rear side wall 24 in FIG. 11. The collector wagon 2 is also coupled to the press 1 having its feeder device 3 in a positionally accurate manner via the coupling guides. The locking bars 15 again serve here to fix the position of the collector wagon 2 relative to the press 1.

The feeder device 3, which corresponds here to the embodiment according to the above-described FIGS. 1 to 3, 6 and 8, can be seen above the collector wagon 2.

A part of the actual press 1 having the press chamber 10, the loading opening 11 having the assigned loading device 12, the pressing plate 13 and the corresponding power drive 14 can be seen on the left-hand side in FIG. 11.

On the bottom side, the collector wagon 2 according to FIG. 11 also has four rollers 25, so as to be able to easily displace the collector wagon 2 from one location to another.

By means of the lifting device 4 in the lower part of the collector wagon 2, the bottom 21 of the collector wagon 2 can also be lifted steadily in lifting direction 40, so as to feed compressible material 5 located in the collector chamber 20 little by little to the feeder device 3 having the rotary grinders 31. The feeder device 3 removes the compressible material 5 from the top and feeds it to the loading device 12 of the press 1, whereby the compressible material 5 reaches into the press chamber 10 of the press 1.

To supply the lifting drive 44 of the lifting device 4 in the collector wagon 2, the latter can either encompass its own power source, such as an electric battery, or can have a connection, by means of which a power supply connection to the press 1 or to another external source can be established.

Figure 12:
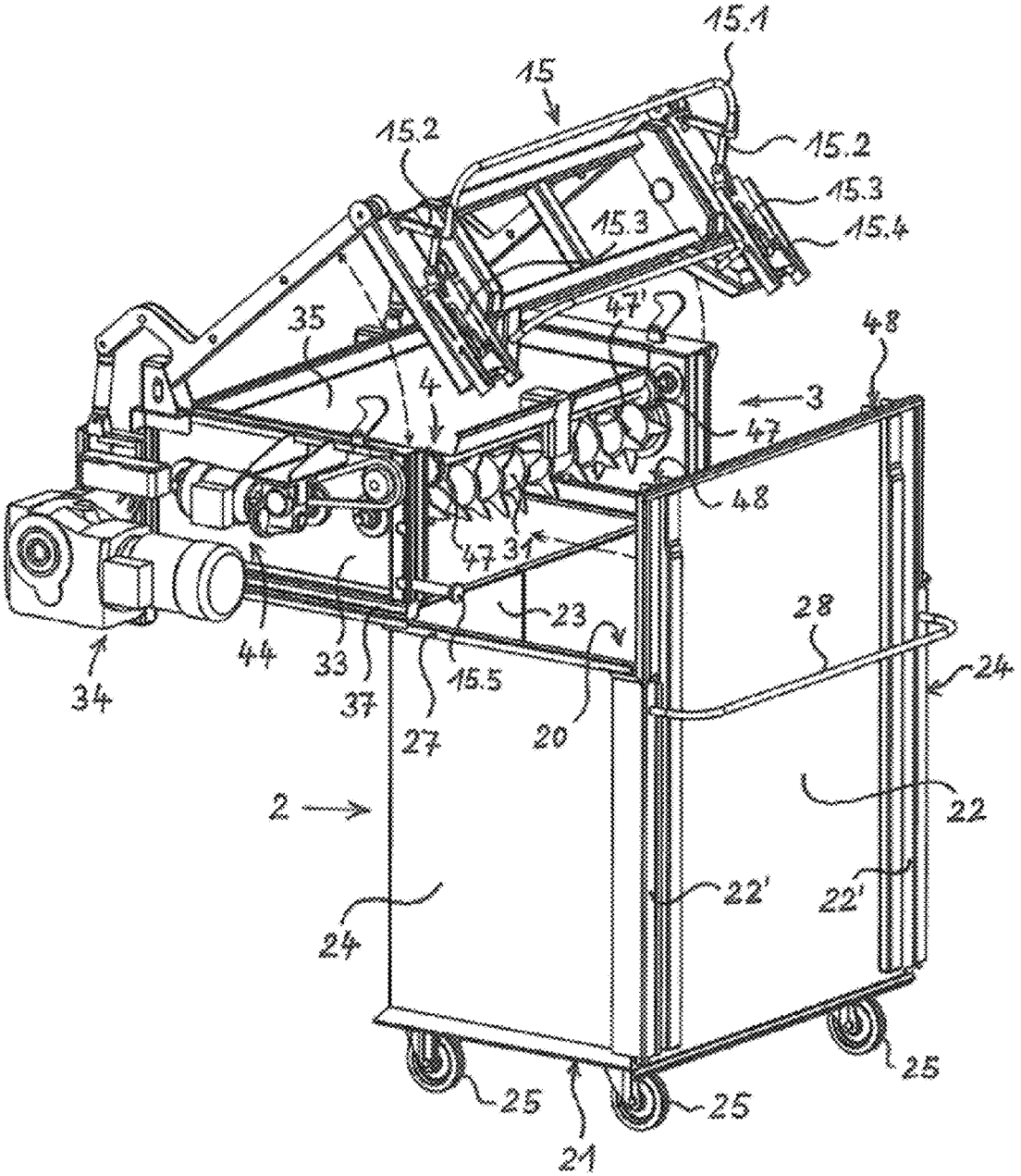
FIG. 12 shows a feeder device, a collector wagon to be coupled and a lifting device as parts of a press, which is incidentally not illustrated herein, in perspective view diagonally from behind.

FIG. 12 shows a feeder device 3 and a lifting device 4 as parts of a press, which is incidentally not illustrated here, together with a collector wagon 2, which is to be coupled. The feeder device 3 is connected here to the rear side of the non-illustrated press.

The feeder device 3 encompasses four rotatable rotary grinders 31, which are arranged below an upper cover 35 and which run parallel to one another, which can be made to rotate in the same direction by means of a common drive 34 consisting of electric motor and angular gear.

The collector wagon 2 has a rectangular bottom 21, which is not visible here, as well as a rear wall 22, a front wall 23 and two side walls 24, which together define a collector chamber 20, which is open towards the top. The collector wagon 2 can be displaced on rollers 25, whereby an operator can grab and steer the collector wagon 2 by a rear-side sliding handle 28. As can be seen from the drawing, the rear wall 22 is extended upwards relative to the further walls 23 and 24. The bottom 21 is furthermore connected to the rear wall 22 to form a bottom-wall element 21, 22, which is displaceably guided as a whole in two lateral rear wall guides 22 in vertical direction relative to the remaining collector wagon 2.

The lifting device 4, which consists of a shaft 47', which runs horizontally and parallel to the rotary grinders 31 and which comprises two gear wheels 47, which are attached thereto so that they cannot rotate, is arranged on the rear side of the feeder device 3, which faces the observer. The shaft 47' having the gear wheels 47 can be made to rotate by means of a drive 44 consisting of an electric motor having an angular drive. Two parallel, vertical gear racks 48, which come into engagement with the gear wheels 47 when the collector wagon 2 is coupled, are arranged on the inner side of the rear wall 22 of the collector wagon 2 facing away from the observer in juxtaposition with the gear wheels 47.

A locking bar arrangement 15, which is embodied as a locking flap and which is located in a lifted release position in FIG. 12, is visible here above the feeder device 3. For this purpose, the locking bar arrangement 15 as a whole can be pivoted about a horizontal axis, which runs parallel to the rotary grinders 31 along the front edge of the feeder device 3 facing away from the observer. The pivotability of the locking bar arrangement 15 is suggested by means of spinning arrows, which are illustrated by means of dashed lines. The locking bar arrangement 15 can furthermore be pivoted about a further horizontal axis. The locking bar arrangement 15 has a locking bar handle 15.1, which can be pivoted between a locked position and a disengaged position by an operator. The movement of the locking bar handle 15.1 is converted into a linear displacement movement of two slotted sliders 15.3 via two toggle lever arrangements 15.2. The sliders 15.3 are guided in diagonal guides 15.4 and interact with two head bolts 15.5 in response to the coupling and locking of the collector wagon 2, as is described in more detail in FIG. 15.

When the collector wagon 2 is coupled and locked by means of the locking bar arrangement 15, the bottom-wall element 21, 22 can be moved upward together with compressible material located in the collector chamber 20 by turning on the lifting device 4 by means of the interaction of the gear wheels 47 with the gear racks 48, whereby, while the feeder device 3 is turned on at the same time, it removes compressible material from the collector wagon 2 from the top and feeds it to the left into the press chamber of the press, which is incidentally not illustrated, according to FIG. 12.

Figure 13:
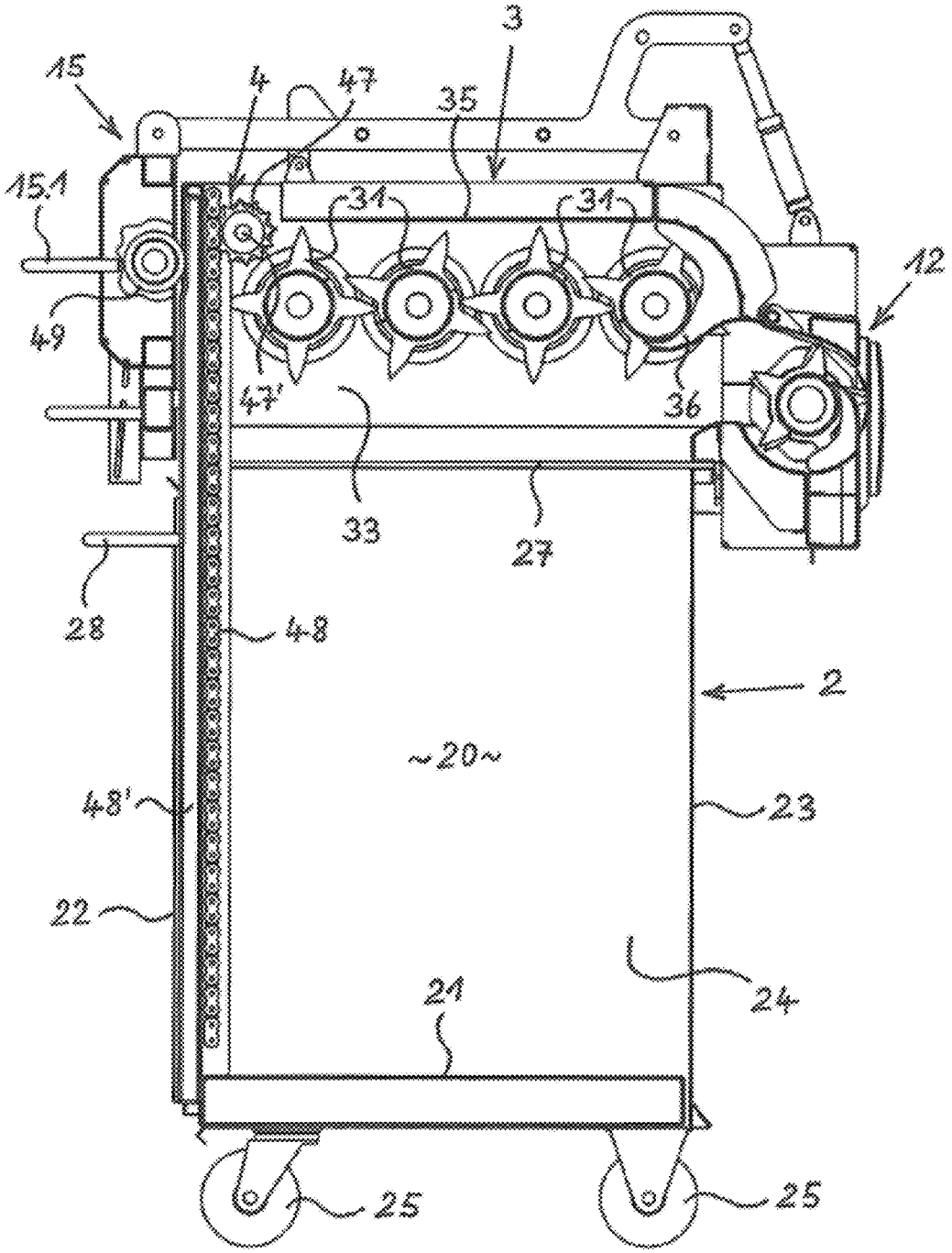
FIG. 13 shows the feeder device, the collector wagon, which has now been coupled, and the lifting device from FIG. 12, in vertical section.

FIG. 13 shows the elements illustrated in FIG. 12 in a vertical section in a direction of view towards the side, which is on the right in FIG. 12 and which faces away from the observer, whereby the collector wagon 2 is now coupled. The feeder device 3 having its four rotary grinders 31 and the cover 35 arranged thereabove is visible on the top in FIG. 13. During operation, the rotary grinders 31 rotate counter-clockwise in the direction of view according to FIG. 13, so that a feeding effect follows from left to right onto the compressible material, which is fed to the feeder device 3 from the bottom.

A loading device 12, which is arranged in or immediately in front of a loading opening of the press, which is incidentally not illustrated here, follows the feeder device 3 towards the right. Here, the loading device 12 consists of a rotor roller, which is equipped with transport teeth and which can be driven by means of rotation, which transports the compressible material through the loading opening of the press into the press chamber thereof.

The coupled collector wagon 2, which can be displaced on its rollers 25, is located below the feeder device 3. To accurately position the collector wagon 2 relative to the feeder device 3, rail-shaped coupling guides 27, which interact with and which are engaged here with non-visible coupling guides on the feeder device 3, are arranged at the upper edge of the side walls 24. On its rear side, which points to the left in FIG. 13, the collector wagon 2 has a sliding handle 28. The bottom 21 and the rear wall 22 are combined to form the bottom-wall element 21, 22 and can be displaced together in vertical direction. This displacement is effected by means of the lifting device 4.

One of the gear wheels 47 of the lifting device 4 having the corresponding shaft 47' is visible in FIG. 13. When the collector wagon 2 is coupled, the gear wheel 47 is now engaged with the gear rack 48, which is arranged on the inner side of the rear wall 22 of the collector wagon 2. In the illustrated exemplary embodiment, the gear rack 48 is a section of a roller chain, which is attached to a profile 48' running in vertical direction in or on the rear wall 22, and which is clamped and fixed at least on its two ends. In the alternative or in addition, the roller chain can also be connected to the rear wall 22 either selectively or via its entire length, for example by welding to the profile 48', to form the gear rack 48. When the lifting device 4 is turned on, the gear wheels 47 rotate clockwise for emptying the collector wagon 2, whereby the bottom-wall element 21, 22 is moved upwards together with compressible material collected in the collector chamber 20 of the collector wagon 2 via the gear racks 48. The direction of rotation of the gear wheels 47 is reversed to lower the bottom-wall element 21, 22 after the emptying.

The locking bar arrangement 15, which is now in its locked position, is visible in FIG. 13 in the top left. For this purpose, the locking bar arrangement 15 is pivoted downwards, whereby it engages behind the upper part of the rear wall 22 from the top. In this locked position, the locking bar arrangement 15 is locked by pivoting the locking bar handle 15.1.

The locking bar arrangement 15 furthermore has two contact rollers 49, which serve the purpose of keeping the gear racks 48 in secure engagement with the gear wheels 47. For this purpose, the contact roller 49 in each case presses against the rear side of the profiles 48' facing away from the gear rack 48, on the front side of which the gear rack 48 is located in each case. When lifting and lowering the bottom-wall element 21, 22, the gear rack 48 together with the profile 48' thus in each case runs upwards or downwards, respectively, between gear wheel 47 and contact roller 49. To compensate wear, the contact rollers 49 can advantageously be readjusted. An engagement of gear wheels 47 and gear racks 48, which is free from play, is permanently ensured in this manner.

Figure 14:
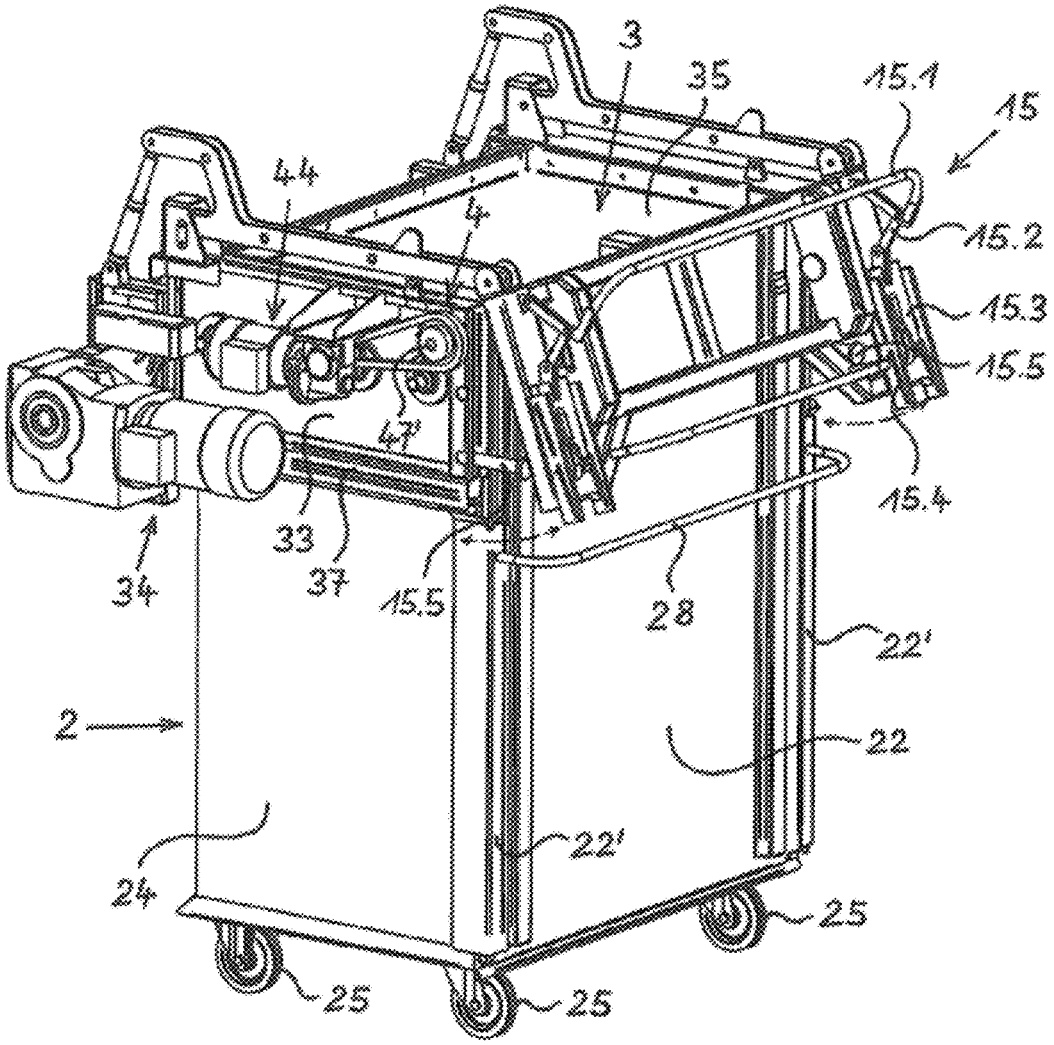
FIG. 14 shows the feeder device, the collector wagon and the lifting device during a last phase of coupling of the collector wagon, again in perspective view diagonally from behind.

In the same representation as FIG. 12, FIG. 14 shows the feeder device 3 together with the collector wagon 2, which is now in its coupled position, but which is not yet fixed. The locking bar arrangement 15 as a whole is now pivoted downwards, whereby the rear part thereof, which faces the observer, having the locking bar handle 15.1 now engages above and behind the upper part of the rear wall 22 of the collector wagon 2, which is extended upwards. By means of a further pivoting movement of the rear part of the locking bar arrangement 15, which is suggested by means of dashed lines, the latter is brought into its final locked position. In FIG. 14, the head bolts 15.5 are not yet engaged with the slotted sliders 15.3 of the locking bar arrangement 15.

With regard to the further reference numerals in FIG. 14, reference is made to the preceding description.

Figure 15:
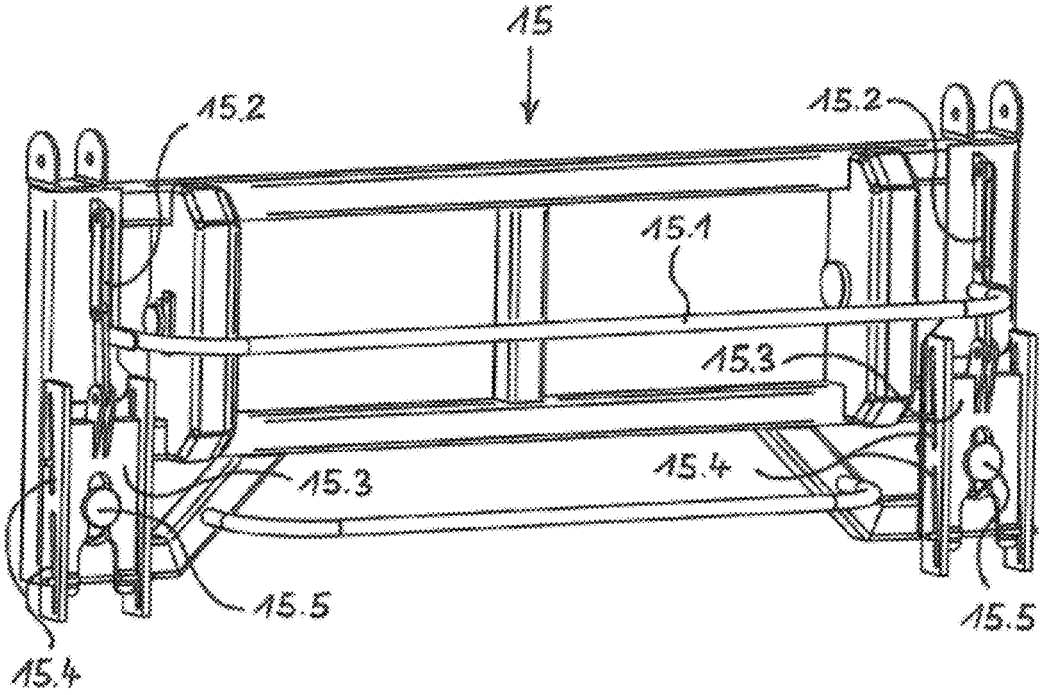
FIG. 15 shows a locking bar arrangement for locking the coupled collector wagon, in a view from behind.

In a view from behind, FIG. 15 shows the locking bar arrangement 15 alone in its locked position. In this locked position, the locking bar handle 15.1 is pivoted downwards by an operator, whereby the toggle lever arrangements 15.2 assume a stretched, self-locking excess dead point position. At the same time, the slotted sliders 15.3 are displaced downwards by pivoting the locking bar handle 15.1, whereby the slots of the sliders 15.3 engage behind the heads of the head bolts 15.5. The sliders 15.3 are at the same time tensioned against the head bolts 15.5 in the axial direction thereof by means of the diagonal guides 15.4. In this locked position, the locking bar arrangement 15 is fixed in its position against the head bolts 15.5 and thus against the feeder device 3. Due to the fact that the rear wall 22 of the collector wagon 2, which is not illustrated here, is located between the locking bar arrangement 15 and the feeder device 3, the collector wagon 2 is also accurately positioned and fixed when the locking bar arrangement 15 is in locked position relative to the feeder device 3.

FIGS. 16 to 21 show a further exemplary embodiment, in the case of which the gear racks 48 of the lifting device 4 are not arranged on the collector wagon 2, but on the feeder device 3.

Figure 16:
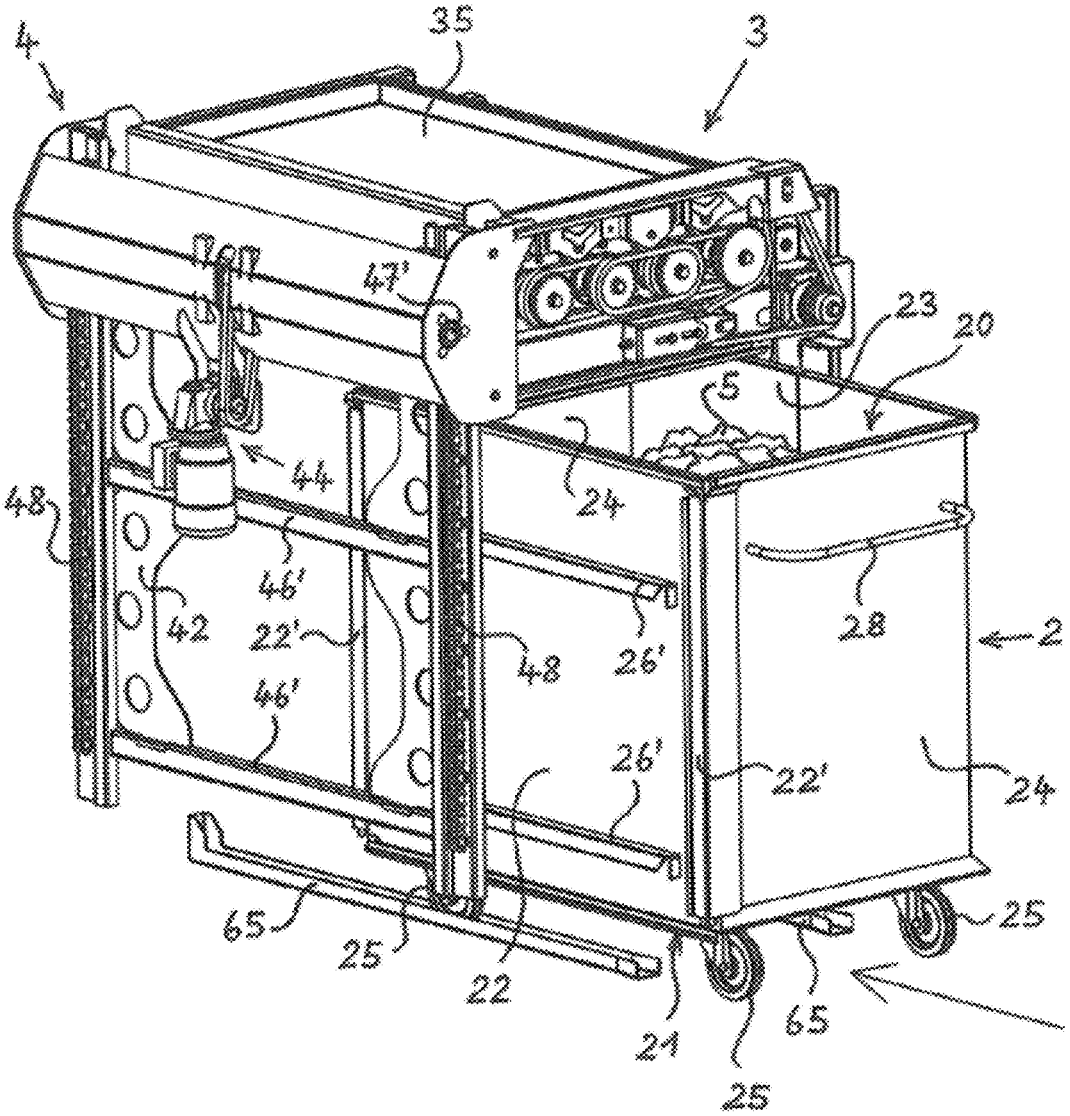
FIG. 16 shows a feeder device, a collector wagon, which is to be coupled, and a lifting device in a changed embodiment as part of a press, which is incidentally not illustrated here, in perspective view diagonally from behind.

FIG. 16 shows, in a perspective view diagonally from behind, the feeder device 3 having the lifting device 4 connected thereto together with a collector wagon 2, which is to be coupled. Here, the feeder device 3 is again embodied in accordance with the afore-described exemplary embodiment. In this regard, reference is thus made to the preceding description.

In FIG. 16, the lifting device 4 is arranged on the rear side of the feeder device 3 facing the observer. Here, the lifting device 4 also has two gear wheels, which are arranged on a common shaft 47' and which are covered in FIG. 16 and which are thus not visible. The shaft 47' can be made to rotate by means of the drive 44 consisting of electric motor and angular gear. The lifting device 4 furthermore comprises a lifting carriage 42, which in each case carries a gear rack 48 on both of its two lateral vertical edges. These gear racks 48 are steadily engaged with the gear wheels on the shaft 47'. The lifting carriage 42 comprises two horizontally running first supporting strips 46', which encompass projections facing diagonally upwards, on the side, which faces the collector wagon 2, which is to be coupled. By turning on the drive 44, the lifting carriage 42 can be displaced upwards and downwards in vertical direction by means of its supporting strips 46'.

The collector wagon 2, which is to be coupled, in the collector chamber 20 of which compressible material to be pressed, for example packaging material 5, such as cardboard boxes, etc., is collected, is visible on the right of FIG. 16. To accurately position the collector wagon 2 relative to the feeder device 3 and to the lifting device 4, an operator guides the collector wagon 2 on the sliding handle 28 thereof having the rollers 25 in two parallel guide rails 65, which are arranged and fastened on the bottom of the set-up space of the press. To facilitate the insertion of the rollers 25 into the guide rollers 65, the latter have in each case a funnel-shaped inlet chamfer in their starting area located on the right in FIG. 16. On the opposite end, the guide rails 65 in each case have a stop for the leading rollers 25.

As is also the case in the afore-described exemplary embodiment of the invention, the bottom 21 and rear wall 22 of the collector wagon 2 according to FIG. 16 are connected to one another to form a bottom-wall element 21, 22, which can be displaced vertically, relative to the remaining collector wagon 2. On the outer side of the rear wall 22 facing the observer, two horizontal supporting strips 26', which are parallel to one another, are fastened, which encompass projections facing outwards and diagonally downwards. By inserting the collector wagon 2 below the feeder device 3 in arrow direction, the first supporting strips 46' of the lifting device 4 and the second supporting strips 46' of the collector wagon 2 come into an adjacent position so as to be located directly on top of one another relative to one another.

Figure 17:
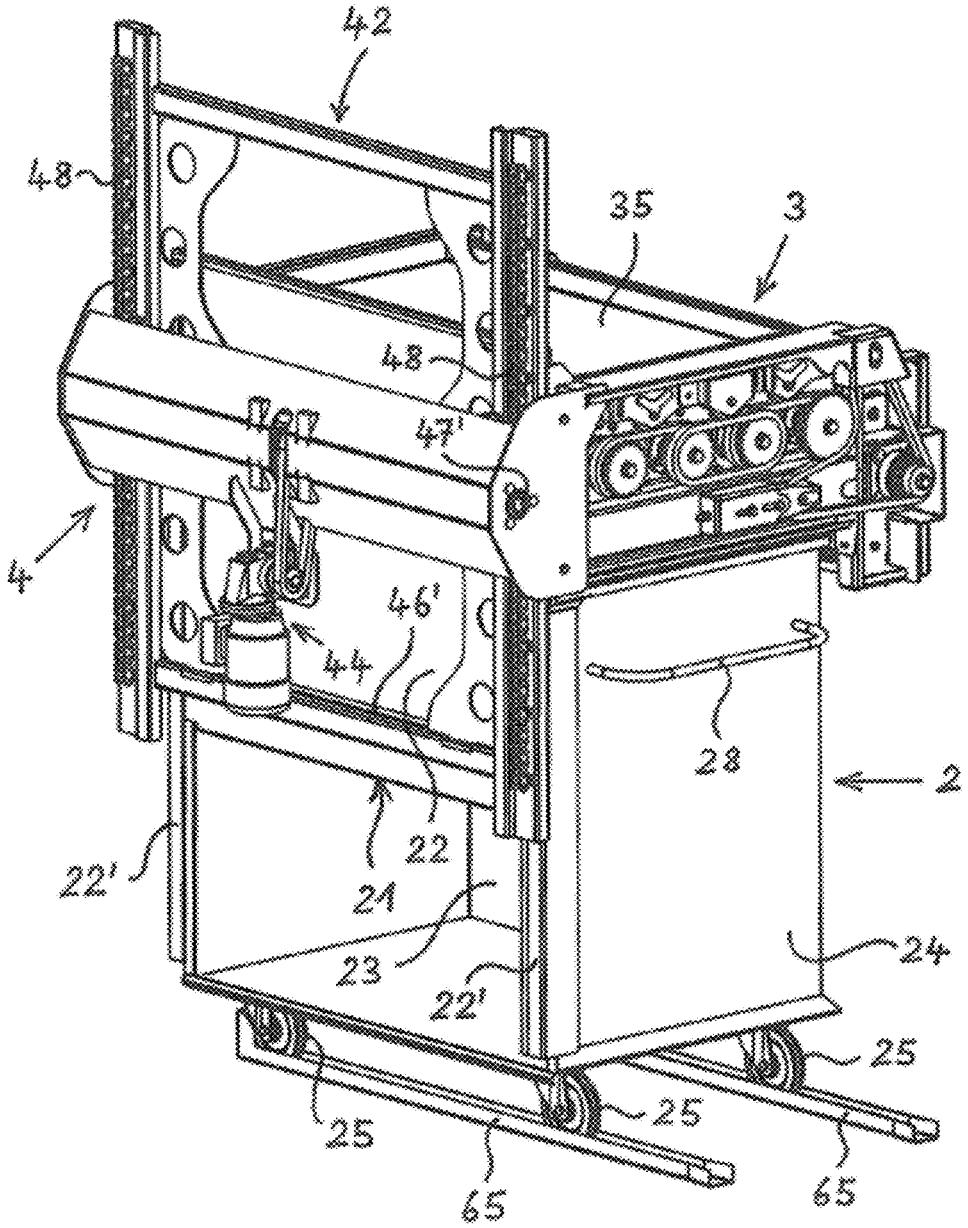
FIG. 17 shows the feeder device, the collector wagon, which is now coupled, and the lifting device from FIG. 16, which is now activated, in the same view as in FIG. 16.

In the same representation as in FIG. 16, the parts of the press shown therein are illustrated in FIG. 17, whereby the collector wagon 2 is now coupled and the lifting carriage 42 together with the bottom-wall element 21, 22 is displaced upwards by a section. In the coupled state, the leading rollers 25 of the collector wagon 2 are located on the stops of the left end of the guide rails 65 in FIG. 17. The first supporting strips 46' of the lifting device 4 furthermore now engage below the second supporting strips 26' on the rear wall 22 of the collector wagon 2, which are covered in FIG. 17, and thus support the bottom-wall element 21, 22, together with the compressible material located in the collector chamber 20. The engagement between the first and second supporting strips 46', 26' is thus disengaged in a technically simple manner for lifting the bottom-wall element 21, 22 simply by lifting the lifting carriage 42 from its lowest position and vice versa by lowering the lifting carriage 42 into its lowest position.

Figure 18:
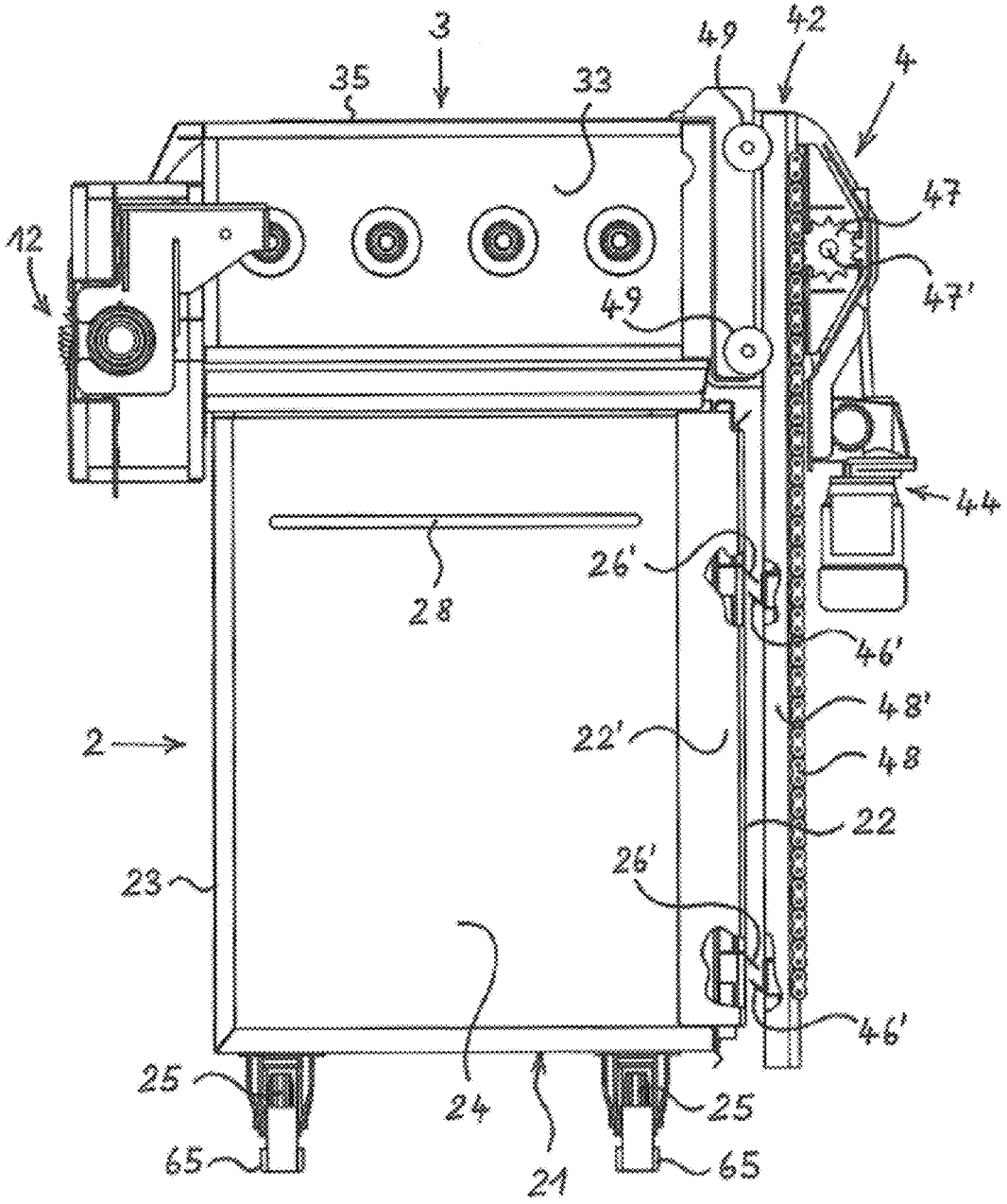
FIG. 18 shows the feeder device, the coupled collector wagon and the lifting device from FIG. 16 and FIG. 17, which is now located in its base position, in a side view.

FIG. 18 now shows the feeder device 3 having the lifting device 4 and the collector wagon 2 from FIGS. 16 and 17 in a side view onto the left side in FIG. 16 and FIG. 17. The afore-described feeder device 3 is visible in FIG. 18 on the top.

The loading device 12 follows the feeder device 3 towards the left and thus in the direction towards the press, which is incidentally not illustrated, here.

The lifting device 4 having its drive 44 and the shaft 47' as well as one of the gear wheels 47 arranged thereon can be seen on the right in FIG. 18. The gear wheel 47 is engaged with the gear rack 48, which is attached to the profile 48', which forms a part of the lifting carriage 42, which can be displaced in vertical direction. On the rear side of the feeder device 3 facing to the right in FIG. 18, two contact rollers 49, which are vertically arranged at a distance from one another, and on which the profile 48' runs with its side, which faces away from the gear rack 48 when the lifting carriage 42 is moved upwards or downwards, are arranged as part of the lifting device 4. By horizontally adjusting the contact rollers 49, an engagement, which is free from play, can be adjusted between gear wheels 47 and gear racks 48.

The collector wagon 2 is located in the guide rails 65 with its rollers 25 below the feeder device 3. The two supporting strips 26', which interact with the two parallel first supporting strips 46' of the lifting carriage 42, are attached on its rear wall 22, which is located on the right in FIG. 18. The first supporting trips 46' of the lifting device 4 are located slightly below the second supporting strip 26' on the rear wall 22 of the collector wagon 2 in the base position of the lifting device 4, which is shown in FIG. 18, in which the lifting carriage 42 assumes its lowest position.

When the drive 44 of the lifting device 4 is turned on, the gear wheel 47 rotates clockwise for lifting the lifting carriage 42, whereby the first supporting strips 46' come to rest on the bottom side of the second supporting strips 26' on the rear wall 22 of the collector wagon 2. By further displacing the lifting carriage 42 upwards, the supporting strips 46' thereof further lift the bottom-wall element 21, 22, which consists of the bottom 21 and the rear wall 22, together with the compressible material collected in the collector wagon 2, whereby the compressible material is moved to the bottom side of the feeder device 3. The feeder device 3 can then remove the compressible material from the top and can feed it into the press chamber of the corresponding press via the loading device 12.

After emptying the collector wagon 2, the lifting carriage 42 is lowered again by rerouting the drive 44, whereby the bottom-wall element 21, 22 is also lowered together with the lifting carriage 42, until the position according to FIG. 18 has been reached again. An operator can now push or pull out the collector wagon 2 from below the feeder device 3 by means of the sliding handle 28, so as to collect compressible material again in the collector wagon 2 at locations at a distance from the press.

Figure 19:
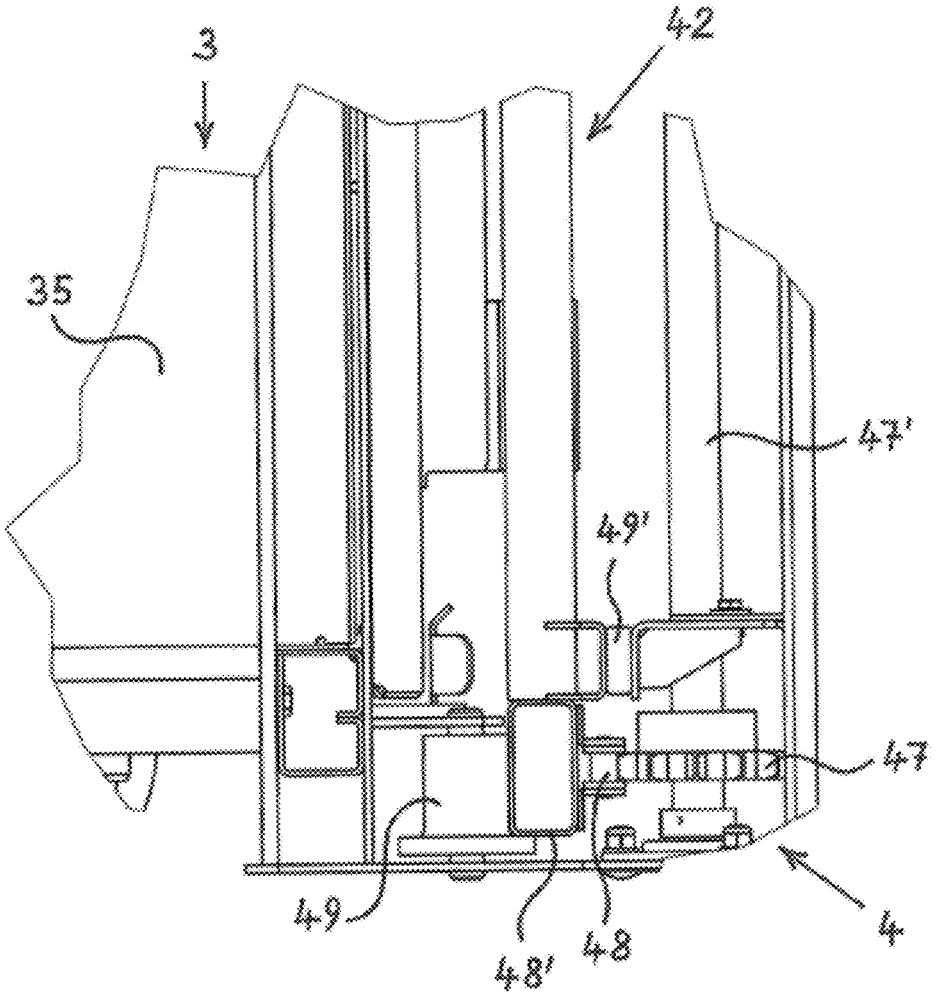
FIG. 19 shows a section of the feeder device and of the lifting device according to FIG. 16 to FIG. 18, in top view.

FIG. 19 shows, in top view, a section of feeder device 3 and lifting device 4, whereby the right front edge area of the feeder device 3 and of the lifting device 4 of FIG. 18 are visible here from the top. One of the gear wheels 47 having the corresponding shaft 47' is visible on bottom right in FIG. 19. The gear rack 48, which is attached to the rectangular profile 48', which runs parallel to it, runs to the left of the gear wheel 47 perpendicular to the drawing plane in FIG. 19. A sliding member 49', e.g. made of polyamide, which runs parallel to the rectangular profile 48' and against which the lifting carriage 42 rests in a sliding manner, serves to adjust an engagement, which is free from play, between gear wheels 47 and gear racks 48 in response to low friction. With its side, which faces away from the gear rack 48, the rectangular profile 48' rests against two contact rollers 49, which are spaced apart from one another in vertical direction, only the upper one of which is visible in FIG. 19. A small part of the feeder device 3 can still be seen on the left in FIG. 19.

Figure 20:
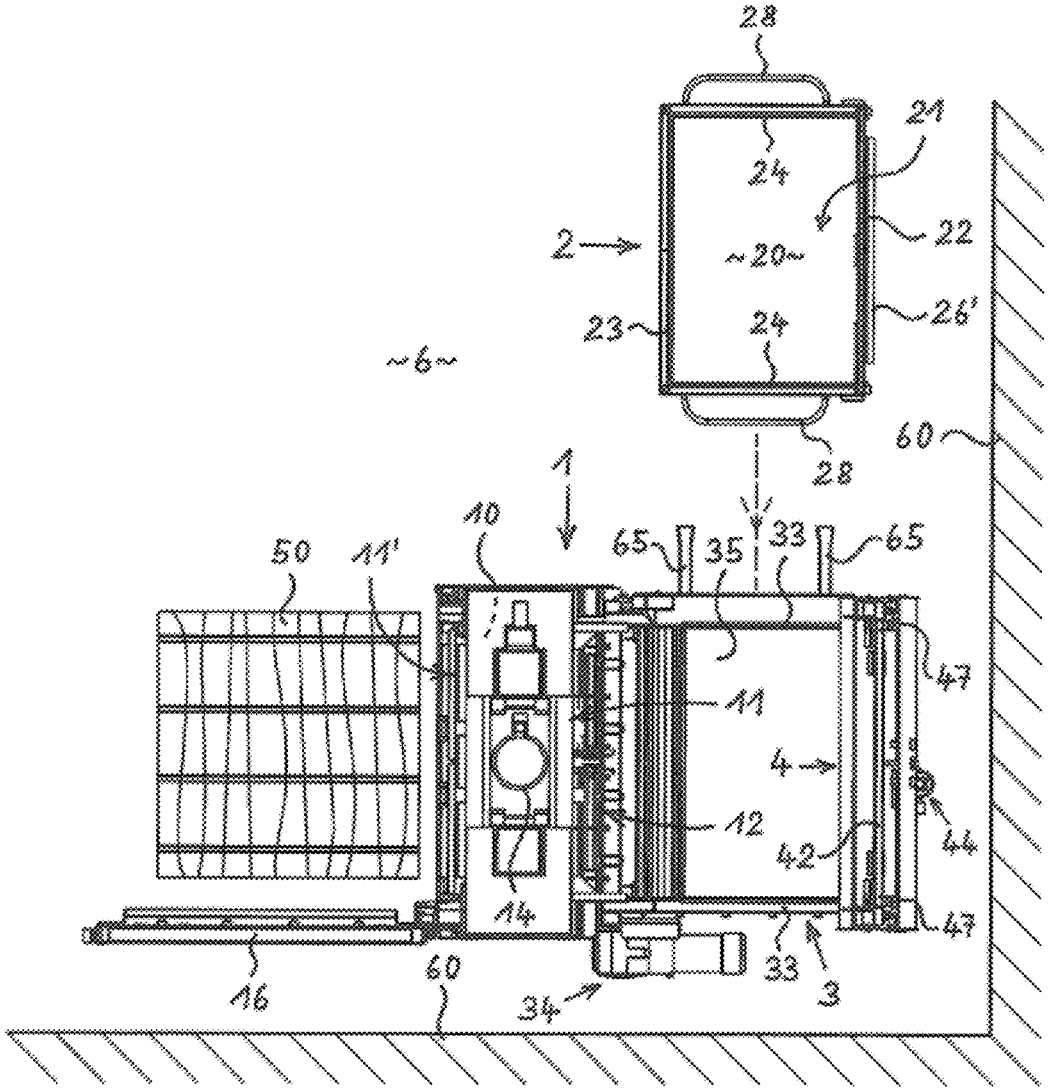
FIG. 20 shows a press, which is set up in a set-up space, together with its feeder device and lifting device as well as having a collector wagon, which is to be coupled, in top view.

FIG. 20 shows a top view onto a press 1, which is arranged in a set-up space 6 in a corner area of two walls 60 of the set up space 6, which run at right angles to one another. In its interior, the press 1 has the press space 10, in which a pressing plate, which is not visible here, can be displaced in vertical direction by means of a power drive 14. In FIG. 20, the front side of the press 1 points to the left. A door 16, which is shown here in the open state, is located at this front side of the press 1. In this open position of the door 16, a pressed bale 50, which is created in the press 1, can be removed from the press chamber 10; it can be tilted forward, for example, onto a transport pallet. A further loading opening 11', which is provided in addition to the loading opening 11, which is arranged on the rear side of the press 1, that is, on the right side in FIG. 20, and which serves for the mechanical loading, is located above the door 16. An operator can manually introduce compressible material into the press chamber 10 of the press 1 through the further front-side loading opening 11', in particular residual quantities or small quantities, for which the use of the collector wagon 2 is not worthwhile.

A collector wagon 2, which is to be coupled to the press 1, is illustrated in FIG. 20 above the press 1, that is, on the left side thereof. The collector wagon 2 also has the rear wall 22, the front wall 23 as well as two side walls 24 here, which together with the bottom 21 form the collector chamber 20, in which compressible material can be collected at locations at a distance from the press 1. By displacing the collector wagon 2 in the direction of the dashed arrow, the rollers arranged on the bottom side of the collector wagon 2 reach into the guide rails 65, in which the collector wagon 2 is then completely slid under the feeder device 3 in a directionally positively guided manner. In this position, the lifting device 4 and the feeder device 3 can be activated, so as to mechanically lift the bottom-wall element 21, 22 via the supporting strips 46', 26' in the afore-described manner and so as to transport compressible material from the collector chamber 20 into the press chamber 10 of the press 1 by means of the feeder device 3 and the loading device 12 through the rear-side loading opening 11. Advantageously, the press 1 can be set up in a room corner close to the walls 60 with its rear side facing the one wall 60 and with its lateral sides, here its right side, facing to the other wall 60. The coupling and uncoupling of the collector wagon 2 takes place from the other lateral side of the press 1, here from its left side.

Figure 21:
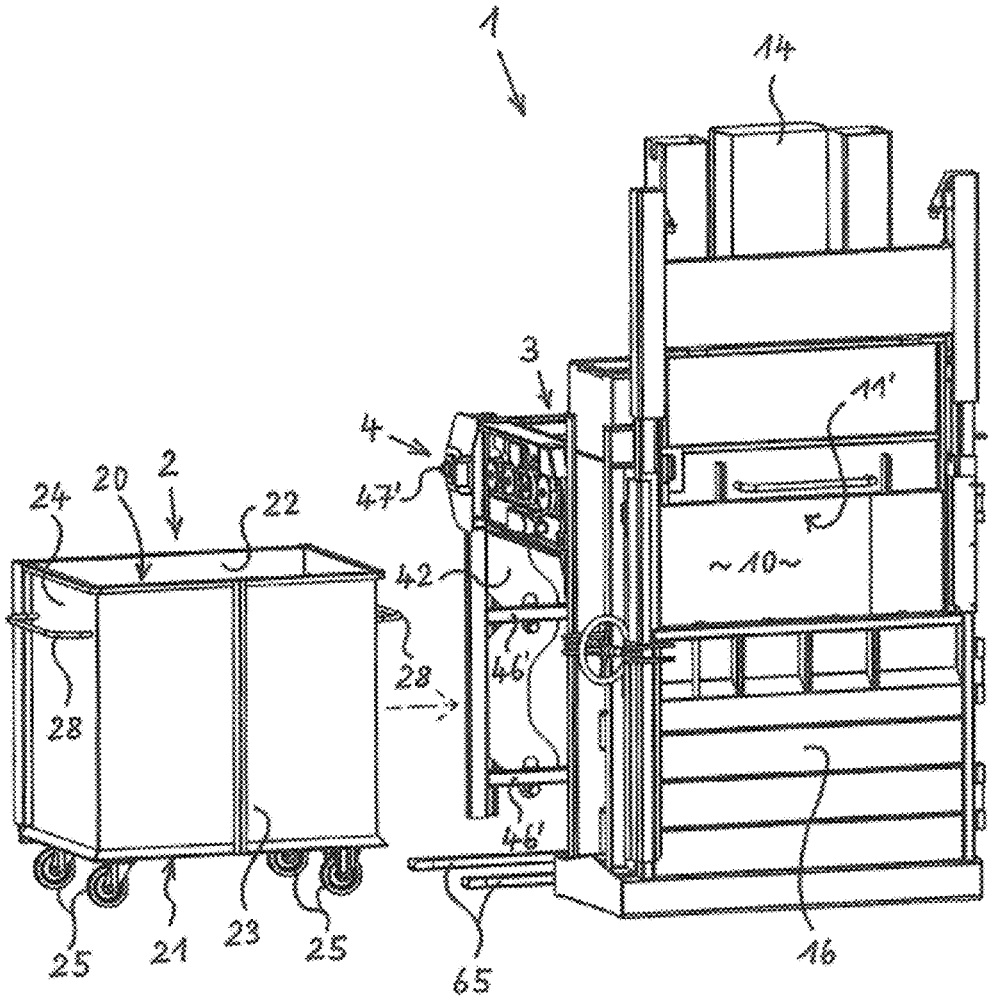
FIG. 21 shows the press from FIG. 20 together with the collector wagon, which is to be coupled, in a frontal view.

FIG. 21 shows the press 1 together with feeder device 3 and lifting device 4 as well as with the collector wagon 2 to be coupled from FIG. 20 in a frontal view. The press 1 can be seen on the right in FIG. 21, now with view to the front side of the press 1. The door 16, through which a pressed bale can be removed from the press chamber 10 of the press 1, is located in this front side. The further loading opening 11', which is open here, so that the view falls to the interior of the press chamber 10, is embodied above the door 16 or is embodied as part of the door 16. The power drive 14 for the pressing plate, which can be displaced vertically in the press chamber 10 and which is not visible, is arranged in the upper part of the press 1.

A part of the feeder device 3 and of the lifting device 4 can be seen on the rear side of the press 1, which faces away from the observer. The collector wagon 2, which is to be coupled, the rear wall 22 of which faces away from the observer here, is located to the left of the press 1. An operator can insert the collector wagon 2 with its rollers 25 into the guide rails 65 by means of the sliding handle 28, as is suggested by the dashed arrow. The bottom-wall element 21, 22 of the collector wagon 2 together with the compressible material to be pressed, which was collected therein, can then be lifted by means of the lifting carriage 42 with its first supporting strips 46'. The feeder device 3 removes the compressible material from the collector wagon 2 from the top and feeds it forward in horizontal direction via the loading device 12, which is not visible in FIG. 21, into the press chamber 10. So that compressible material does not fall forward out of the press chamber 10 thereby, the front-side loading opening 11' is advantageously closed in response to the mechanical loading of the press chamber 10, and it goes without saying that the door 16 is then also closed.

Figure 22:
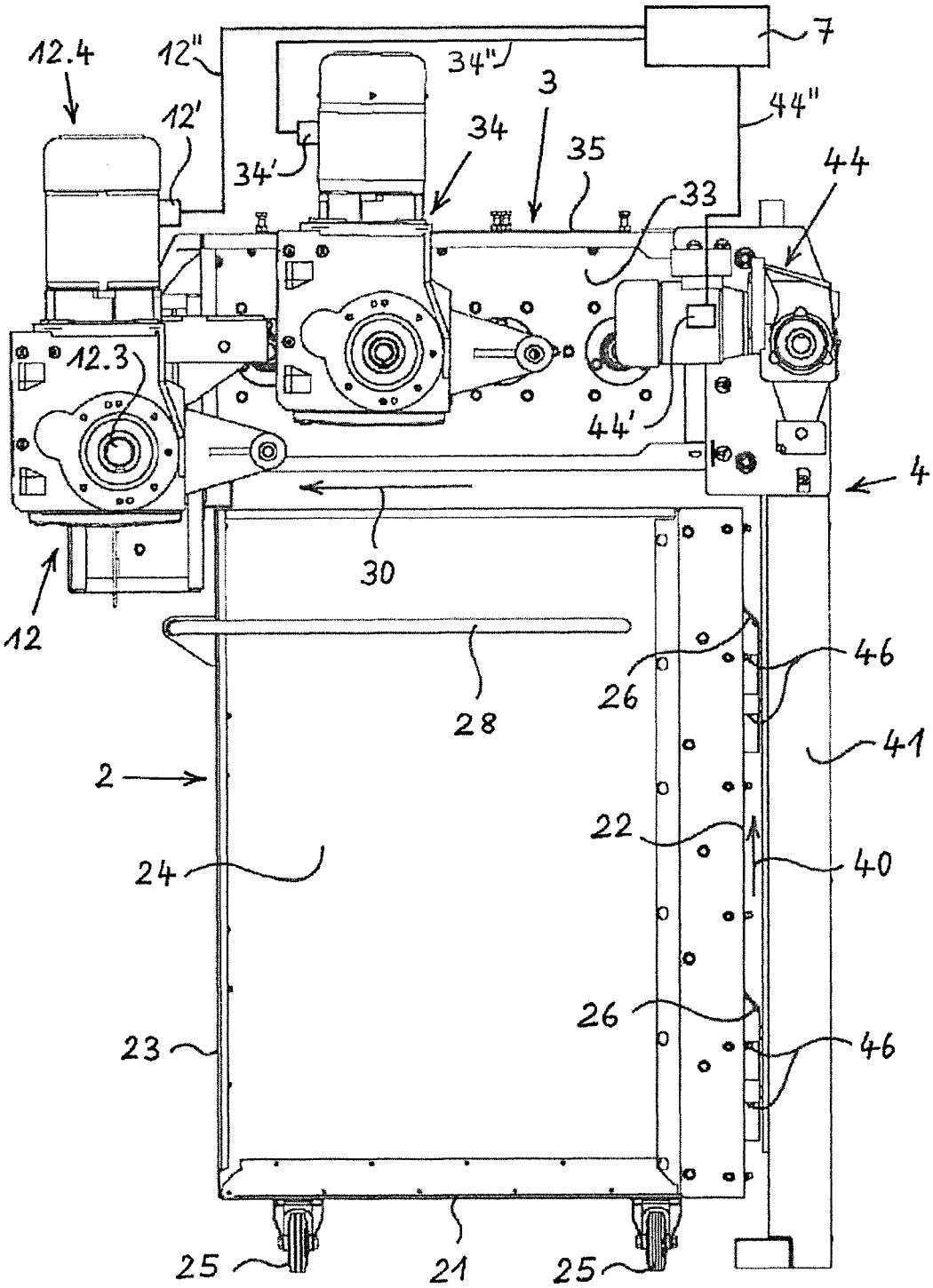
FIG. 22 shows a feeder device having a coupled collector wagon, a lifting device and a loading device as parts of a press, which is incidentally not illustrated here, in side view.

FIG. 22 shows a loading device 12, a feeder device 3 and a lifting device 4 as parts of a press, which is incidentally not illustrated here, together with a coupled collector wagon 2. The feeder device 3 is connected here to a loading side of the non-illustrated remaining press, which must be envisioned to the left of the collector wagon 2. The loading device 12 is arranged on and partially even in the loading opening of the press.

The feeder device 3 encompasses here four rotary grinders, which run parallel to one another and which can be driven by means of rotation, which are arranged below an upper cover 35 and between side flanges 33 and the axes of rotation of which run perpendicular to the drawing plane. During operation, the rotary grinders can be made to rotate in the same direction means of a common drive 34 consisting of electric motor and angular gear, but at rotational speeds, which are different relative to one another. The rotary grinder, which is located closest to the loading device 12, thereby has the highest rotational speed, while the rotary grinder, which is located farthest away from the loading device 12, has the smallest rotational speed.

The collector wagon 2 has a rectangular bottom 21 as well as a rear wall 22, a front wall 23 and two side walls 24, which together define a collector chamber, which is open towards the top. The collector wagon 2 can be displaced on rollers 25, whereby an operator can grab and steer the collector wagon 2 by a sliding handle 28. The bottom 21 is connected to the rear wall 22 to form a bottom-wall element 21, 22, which is displaceably guided as a whole in vertical direction relative to the remaining collector wagon 2.

The lifting device 4 is arranged on the rear side of collector wagon 2 and feeder device 3, which points to the right in FIG. 22. It consists here of a lifting frame 41, which is arranged in a vertical plane, on which a lifting carriage, which is covered here, can be displaced vertically by means of a lifting drive 44. The lifting carriage has hooks 46, which project in the direction of the collector wagon 2, and which can be engaged with and disengage from the collector wagon 2, more accurately with the hook accommodations 26, which are arranged on the rear wall 22 thereof. When the collector wagon is coupled, as is illustrated in FIG. 22, and when the engagement has been established, the bottom-wall element 21, 22 of the collector wagon 2 can be moved upwards together with the compressible material located therein in lifting direction 40 by means of the lifting drive 44, whereby, when the feeder device 3 is turned on at the same time, the latter removes compressible material from the collector wagon 2 from the top and feeds it to the left into the press chamber of the press, which is incidentally not illustrated.

The loading device 12, the feeder device 3 and the lifting device 4, preferably the drives 12.4, 34 and 44 thereof, are furthermore in each case equipped with a power demand sensor 12', 34' and 44', which captures the power consumption, e.g. A preferably electronic control unit 7 is assigned to the press 1, to which measuring signals on lines 12", 34" and 44" of the power demand sensors 12', 34' and 44' can be fed and by means of which the output of the loading device 12, the feeder device 3 and/or the lifting device 4 or the drives 12.4, 34 and 44 of which, respectively, can be changed and/or the operating direction of which can be reversed in accordance with the fed measuring signals. An imminent overload, which is captured by one power demand sensor or by a plurality of power demand sensors, can thus be counteracted by automatic control interventions before damages are caused, in that the output of one drive or of a plurality of drives is/are reduced or is/are reversed in the operating direction thereof. After a certain time, the output of the respective drives can then be increased again automatically or can be switched back into the normal operating direction, respectively, so as to continue the filling of the press chamber.

Figure 23:
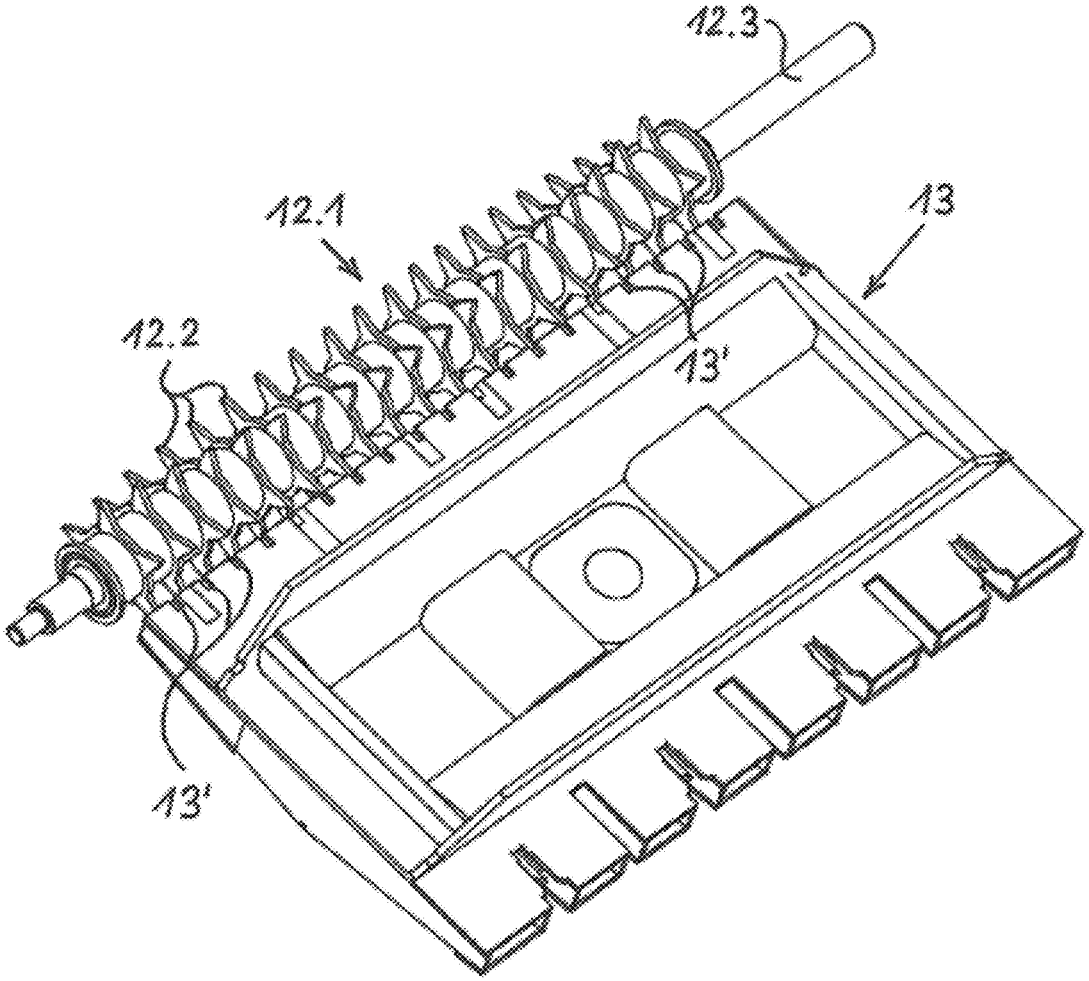
FIG. 23 shows a rotor roller of the loading device and a pressing plate of the press, in perspective view, diagonally from the top.

FIG. 23 shows a pressing plate 13 as well as a rotor roller 12.1 as individual parts of the press shown in FIG. 22, in a perspective view diagonally from the top. The pressing plate 13 can be displaced vertically downwards and upwards in the press chamber of the press, whereby a press stroke takes place from top to bottom. The pressing plate 13 thereby moves between a position above and a position below the rotor roller 12.1. To be able to feed compressible material into the press chamber of the press as far as possible by means of the rotor roller 12.1, transport teeth 12.2 of the rotor roller 12.1 project into the movement area of the pressing plate 13. To prevent a mutual collision and damages, the pressing plate 13 encompasses passage slots 13', which are arranged so as to match the transport teeth 12.2 at its edge, which faces the rotor roller 12.1. When the pressing plate 13 moves past the rotor roller 12.1 in response to its vertical movement, the transport teeth 12.2, which project into the press chamber, run through the passage slots 13' of the pressing plate 13, without colliding with it. Due to this arrangement, in the case of which the rotor roller 12.1 of the loading device 12 projects into the press chamber of the press, it can feed the compressible material into the press chamber in a particularly effective manner. Due to the fact that the passage slots 13' encompass only a relatively small depth and width, they do not impact the stability and press function of the pressing plate 13.

Figure 24:
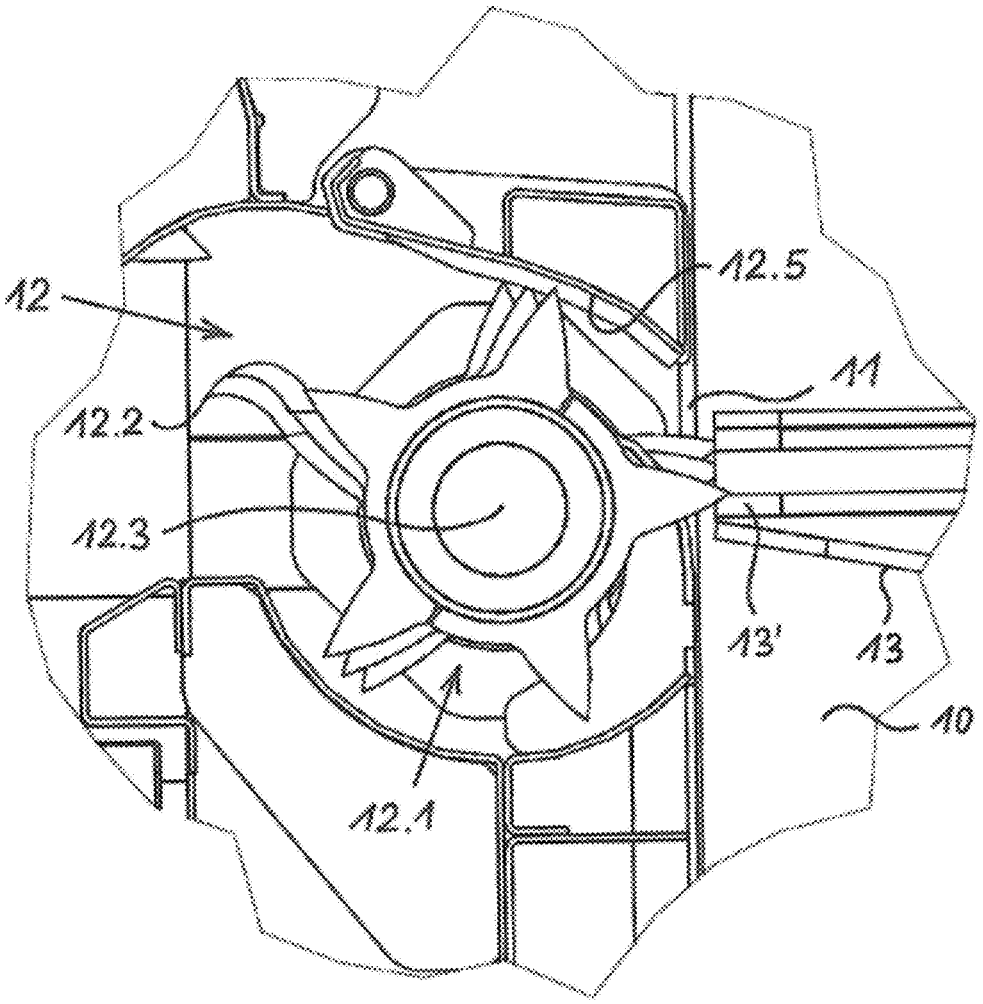
FIG. 24 shows the rotor roller and the pressing plate from FIG. 23 in vertical section.

FIG. 24 shows the loading device 12 and a part of the pressing plate 13 of the press in a vertical section, which runs perpendicular to the axle 12.3 of the rotor roller 12.1 of the loading device 12. As is illustrated in FIG. 24, the rotor roller 12.1 is located directly in front of and partially even in the loading opening 11 of the press, whereby the projecting transport teeth 12.2 of the rotor roller 12.1 project into the press chamber 10. The pressing plate 13, which can be displaced vertically in the press chamber 10, is specifically located in a position at the level of the rotor roller 12.1. It becomes visible thereby, how one of the transport teeth 12.3 passes through the corresponding passage slot 13' of the pressing plate 13.

A guide surface 12.5, which is arranged at a smaller distance from the orbit of the outer tips of the transport teeth 12.2 of the rotor roller 12.1, can be seen above the rotor roller 12.1. The guide surface 12.5 can be pivoted and the distance thereof from the rotor roller 12.1 can thus be adjusted by means of a joint, which is provided on the left end of the guide surface 12.5, for example by means of a mechanical or motor-driven adjusting means or by means of the compressible material, which is fed, even against a preloading force, such as the force of a spring, which is not illustrated here. The guide surface 12.5 ensures a secure engagement of the transport teeth 12.2 with the compressible material to be fed.

Figure 25:
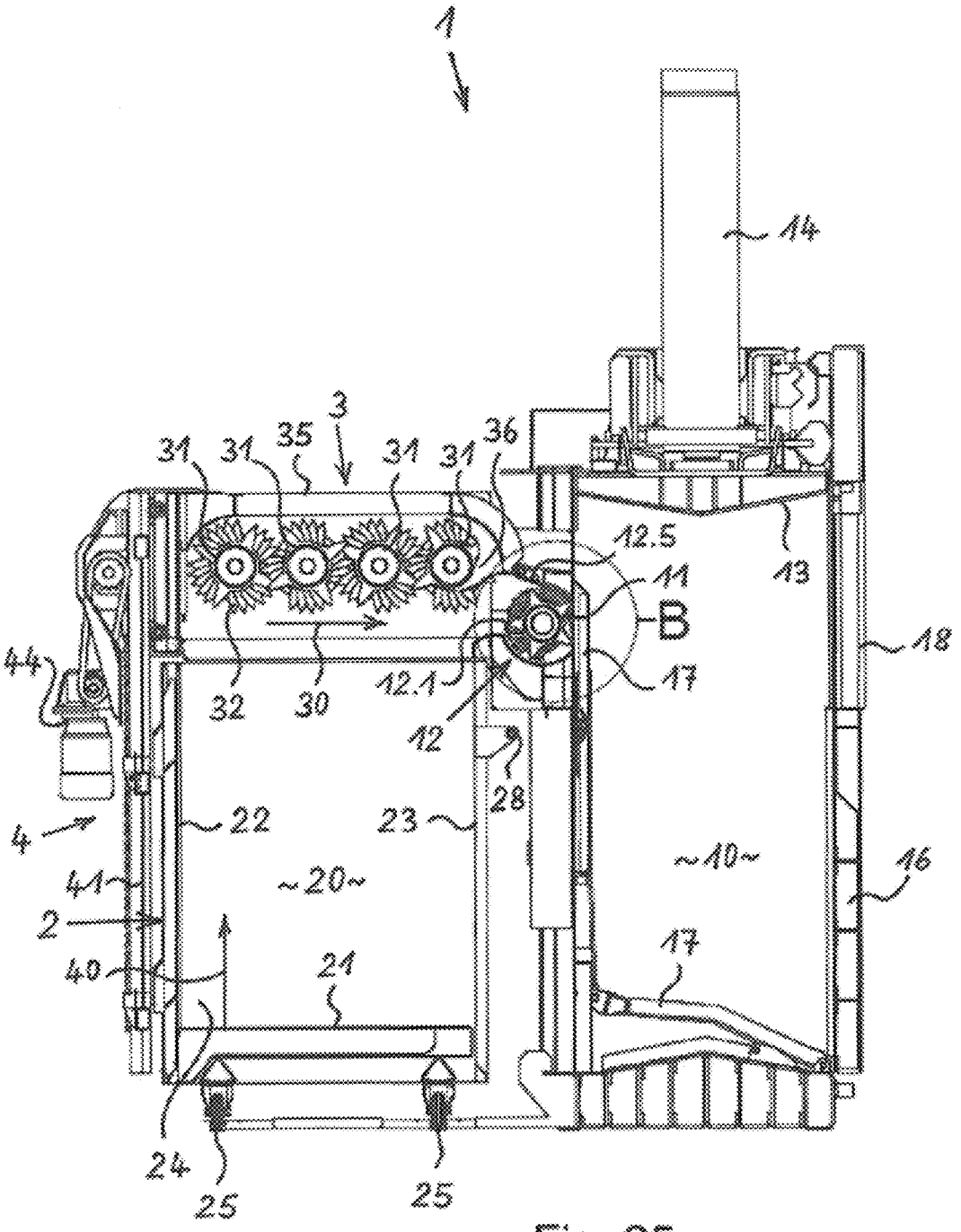
FIG. 25 shows a complete press having a feeder device, lifting device and loading device as well as having a bale ejector, together with a coupled collector wagon, in vertical section.

FIG. 25 shows, in vertical section, a complete press 1 with feeder device 3, lifting device 4 and loading device 12, together with a coupled collector wagon 2, whereby opposite to FIG. 22, the collector wagon 2 is now located on the left and the press 1 is located on the right. On the top in FIG. 25, the feeder device 3 is visible with its four rotary grinders 31 and the cover 35 arranged thereabove. During operation, the rotary grinders 31 rotate counter-clockwise, in the direction of view according to FIG. 23, so that a feeding effect follows from left to right onto the compressible material, which is fed to the feeder device 3 from the bottom. A scraper 36, projecting between the grinding teeth of the last rotary grinder 31, which removes the compressible material from the latter, so as to reliably transfer it to the loading device 12, is assigned to the last rotary grinder 31, which faces the loading device 12.

To the right, the loading device 12, which is arranged directly in front of and partially in a loading opening 11 of the press 1 illustrated here, follows the feeder device 3. Here, the loading device 12 consists of a rotor roller 12.1, which is equipped with transport teeth and which can be driven by means of rotation, which transports the compressible material through the loading opening 11 of the press 1 into the press chamber 10 thereof. Viewed in the direction of view according to FIG. 25, the rotor roller 12.1 of the loading device 12 rotates clockwise during operation, whereby compressible material is transported between the upper side of the rotor roller 12.1 and the guide surface 12.5 arranged thereabove and is fed into the press chamber 10 by means of a movement component, which points diagonally downwards.

The coupled collector wagon 2, which can be displaced on its rollers 25, is located below the feeder device 3. On its front side, which points to the right in FIG. 25, the collector wagon 2 has a sliding handle 28, which can also extend across the two side walls 24. The bottom 21 and the rear wall 22 are combined to form the bottom-wall element 21, 22 and can be displaced together in vertical direction. This displacement is effected by means of the lifting device 4.

Of the lifting device 4, a part of the lifting frame 41 with the lifting drive 44 is visible in FIG. 25. Here, the lifting device 4 is mechanically connected to the feeder device 3 and is supported by it. When the lifting device 4 is turned on, the bottom-wall element 21, 22 is moved upwards in lifting direction 40 together with compressible material collected in the collector chamber 20 of the collector wagon 2. The operating direction of the lifting device 4 is reversed to lower the bottom-wall element 21, 22 after the emptying.

A door 16, through which a completed pressed bale can be removed from the press chamber 10 of the press 1, is located in the front side of the press 1, which points to the right. For this purpose, the press 1 encompass a bale ejector 17, which has an embodiment, which is known per se, and which extends upwards from a bottom area of the press chamber 10 on the rear wall thereof, which is located on the left in FIG. 25. When a pressed bale has been pressed completely and, if applicable, has been bound within the press chamber 10, the door 16 is opened and the bale ejector 17 is actuated. The bale ejector 17 moves the pressed bale in the press chamber 10 upwards along the rear side thereof and thereby tilts it forward at the same time, so that the pressed bale tilts out of the press chamber 10 through the open door 16 about an angle of approximately 90°. For example, a palette, on which the pressed bale is tilted, can be arranged in front of the press 1 for further transporting the pressed bale. After closing the door 16 and moving the bale ejector 17 back into its base position, compressible material can again be fed and can be compressed in the press 1 to form a further pressed bale.

A power drive 14 for the pressing plate 13, which can be displaced vertically in the press chamber 10, here in the form of a simple or double piston-cylinder unit, is arranged in the upper part of the press 1.

Figure 26:
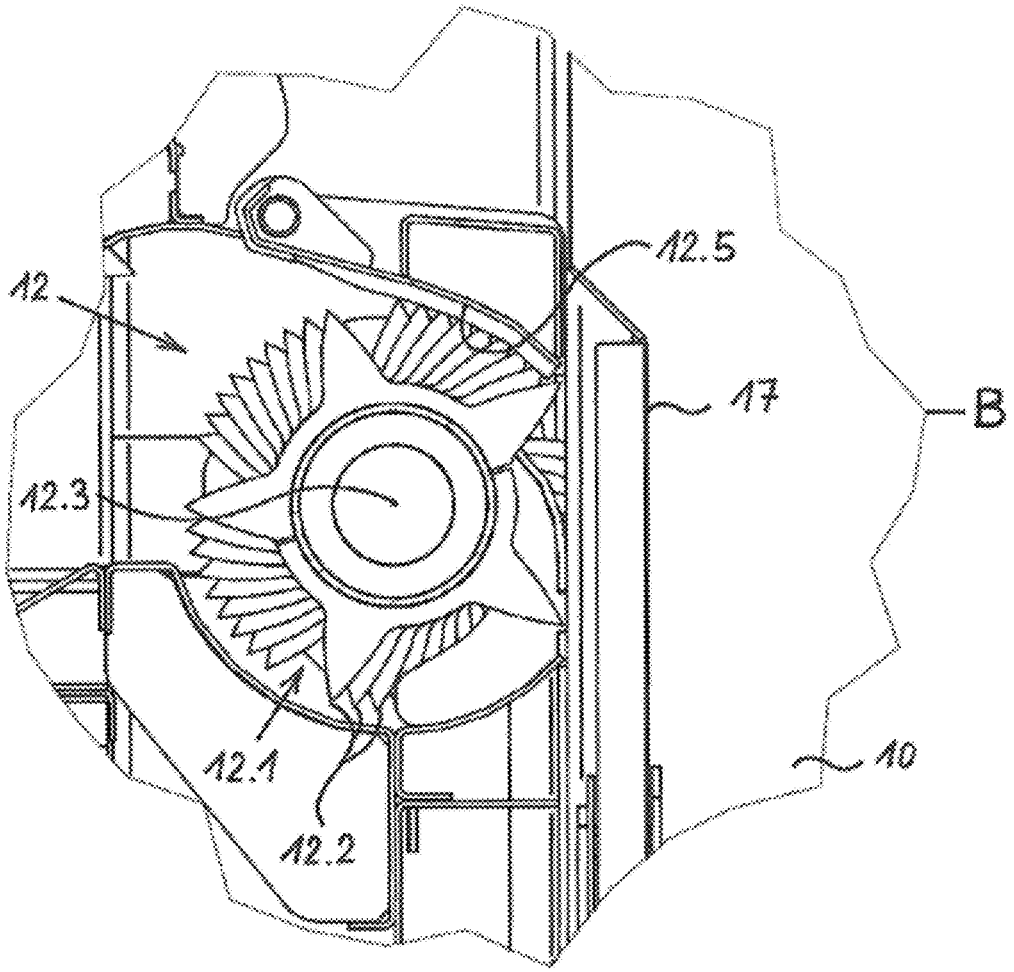
FIG. 26 shows the detail B circled in FIG. 25 having the rotor roller and bale ejector in an enlarged illustration.

FIG. 26 shows, in a partial vertical section, the loading device 12 together with a part of the bale ejector 17 from FIG. 25. It can be seen thereby that the bale ejector 17 is in its activated, lifted position in the movement area of the transport teeth 12.2 of the rotor roller 12.1. To reliably prevent a damaging collision between the bale ejector 17 and the rotor roller 12.1, at least one rotational position sensor, which captures the current rotational position of the rotor roller 12.1 and transfers it to a control unit, is assigned to the rotor roller 12.1. When the rotor roller 12.1 is stopped, the control unit, in accordance with the rotational position sensor, ensures that the rotor roller comes to a standstill in a certain rotational position with regard to the projecting transport teeth 12.2 thereof. This specific rotational position is thereby defined such that the transport teeth 12.2 no longer come into contact with the bale ejector 17 in it, when the latter is moved upwards from below in response to its activation for ejecting a completed pressed bale.

As does FIG. 24, FIG. 26 furthermore also shows the axle 12.3 of the rotor roller 12.1 as well as the guide surface 12.5 arranged thereabove.

Figure 27:
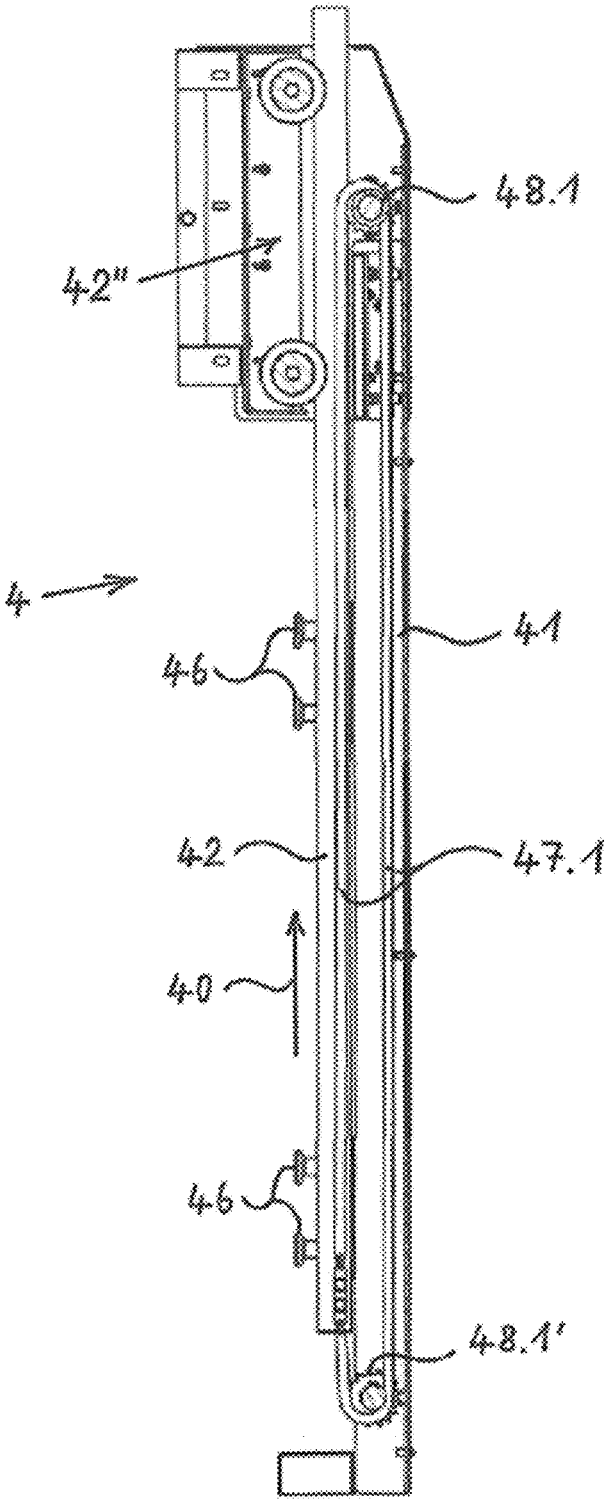
FIG. 27 shows the lifting device from FIG. 22 as individual part, in vertical section.

FIG. 27 finally shows the lifting device 4 of the press 1 from FIG. 22 as an individual part in a vertical section. The supporting part of the lifting device 4 forms a lifting frame 41, which is arranged in a vertical plane. A lifting carriage 42 can be displaced vertically upwards and downwards along the lifting frame 41 while being guided by a carriage guide 42". The lifting drive, which is not visible herein and which is located in front of the sectional plane, for example electric motor or hydraulic motor with gear mechanism, which drives one of two gear wheels 48.1 and 48.1' during operation, serves here to displace the lifting carriage 42. The gear wheels 48.1 and 48.1' are supported on the top and on the bottom of the lifting frame 41 at the same vertical distance on top of one another, and a continuous traction mechanism 47.1, such as a roller chain, is guided across the two gear wheels 48.1, 48.1'.

In FIG. 27, the lifting carriage 42 assumes its lowermost position and is only connected to the traction mechanism 47.1 at its lower end, so that a large displacement path follows for the lifting carriage 42, which virtually corresponds to the distance of the gear wheels 48.1 and 48.1'. Two pairs of two projecting hooks 46 are in each case arranged here on the lifting carriage 42. They serve to engage with a collector wagon 2, which is to be coupled more accurately with the vertically movable parts thereof, such as the bottom-rear wall element 21, 22 thereof, so as to move the compressible material in the collector wagon 2 upwards in the direction of the feeder device 3 according to FIG. 25, and so as to move the bottom-rear wall element 21, 22 downwards again after removing the compressible material. The collector wagon 2 can then be uncoupled again from the lifting device 4 and can be brought to a collecting location for compressible material.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

LIST OF REFERENCE NUMERALS

Numeral Description
1 press
10 press chamber
11 rear-side loading opening
11' front-side loading opening
12 loading device
12' power demand sensor
12" fed signal line
12.1 rotor roller
12.2 transport teeth
12.3 axle
12.4 drive
12.5 guide surface
13 pressing plate
13' passage slots for 32
14 power drive
15 locking bar arrangement
15.1 locking bar handle
15.2 toggle lever arrangements
15.3 slotted sliders
15.4 diagonal guides
15.5 head bolt
16 door
17 bale ejector
2 collector wagon
20 collector chamber
21 bottom
22 rear wall
22' rear wall guides
23 front wall
24 side walls
25 rollers
26 accommodations for 46
26' second supporting strip(s)
27 coupling guides on 2
28 sliding handle
3 feeder device
30 feeding direction
31 rotary grinder(s)
31' conveyor belt
32 conveyor teeth
33 side flanges
34 drive
34' power demand sensor
34" fed signal line
35 cover
36 scraper
37 coupling guides on 3
4 lifting device
40 lifting direction
41 lifting frame
42 lifting carriage
42' lifting arms
42" carriage guide
43 scissor-type lifting arrangement in 2
44 lifting drive
44' power demand sensor
44" fed signal line
45 folding lever
46 hooks
46' first supporting strip(s)
47 gear wheel for 48
47' shaft
47.1 continuous traction mechanism
48 gear rack
48' rectangular profile
48.1, 48.1' gear wheels for 47.1
49 contact roller
49' sliding member
5 compressible material
50 pressed bale
6 set-up space
60 walls of 6
65 guide rails

The invention claimed is:

1. A combination of a press, a feeder device, and at least one collector wagon for compressible material comprising:

the press having:

a press chamber, a press plate within the press chamber driven by a power drive, and first coupling elements located on the at least one collector wagon and second coupling elements located on one of the press or the feeder device, the first and second coupling elements arranged to engage and couple with each other to permit the at least one collector wagon to be coupled and uncoupled to the press in a region of the feeder device, the at least one collector wagon encompassing a collector chamber having a floor and walls arranged to receive compressible material, a lifting device powered by a lifting drive and arranged to engage and displace at least the floor of the at least one collector wagon upward from a lower collecting position for emptying the collector chamber and downward to the lower collecting position for filling the collector chamber, the at least one collector wagon being arranged to be fillable with compressible material in a state where the at least one collector wagon is uncoupled from the press and is at a location at a distance from the press, the feeder device being arranged at a position directly above the at least one collector wagon to engage the compressible material present in the at least one collector wagon while above the at least one collector wagon as at least the floor is displaced upward, being arranged to continuously remove the compressible material from the at least one collector wagon and being arranged to feed the compressible material to the press chamber.

2. The combination according to claim 1, wherein the feeder device is connected to the press.

3. The combination according to claim 1, wherein the feeder device is embodied as one of a rotary cutter having a rotary grinder, a rotary cutter having a plurality of parallel rotary grinders, which can be driven in the same direction by means of rotation, and one of a drivable conveyor belt and conveyor chain arrangement, which is equipped with transport teeth.

4. The combination according to claim 3, wherein the feeder device is embodied as a rotary cutter having a plurality of parallel rotary grinders, which can be driven in the same direction by means of rotation, wherein the rotary grinders are equipped with teeth and the teeth of adjacent rotary grinders are overlapping and horizontally offset relative to one another.

5. The combination according to claim 3, whereby the feeder device is embodied as a rotary cutter having a plurality of parallel rotary grinders, which can be driven in the same direction by means of rotation, wherein the rotary grinders are arranged to be driven at rotational speeds which are different relative to one another, whereby a first rotary grinder, which is located closest to the press chamber, is arranged to be driven at the highest rotational speed and a second rotary grinder, which is located farthest away from the press chamber, is arranged to be driven at the lowest rotational speed.

6. The combination according to claim 5, wherein all of the rotary grinders are arranged to be driven by a common drive via gearbox elements, which are in each case translated differently.

7. The combination according to claim 1, wherein, the floor of the at least one collector wagon is connected to a rear wall of the at least one collector wagon to form an L-shaped bottom-wall element, and the bottom-wall element is slidably arranged in guides on the at least one collector wagon to be lifted and lowered relative to the remainder of the at least one collector wagon.

8. The combination according to claim 1, wherein a lifting device is arranged at one of the press and the feeder device, the lifting device being arranged to lift and lower at least the floor of the at least one collector wagon when the at least one collector wagon is coupled to the press.

9. The combination according to claim 8, wherein the lifting device is formed by means of at least one vertical revolving continuous traction mechanism, which can be driven in two directions and which, in response to coupling of the at least one collector wagon to the press, comes into either direct or indirect engagement with the floor of the at least one collector wagon that can be lifted and lowered.

10. The combination according to claim 9, wherein the at least one traction mechanism is engaged with a lifting carriage, which is guided so as to be vertically displaceable on one of the press or the feeder device and which comes into engagement with the floor of the at least one collector wagon that can be lifted or lowered, in response to coupling of the at least one collector wagon to the press.

11. The combination according to claim 9, wherein the at least one traction mechanism is a roller chain, which is guided via two gear wheels, which are arranged vertically on top of one another at one of the press and the feeder device, at least one of which gear wheels can be driven by means of rotation.

12. The combination according to claim 1, wherein the first and second coupling elements comprise coupling guides and wherein the combination further comprises locking bars arranged at the at least one collector wagon and the feeder device, the coupling guides engaging with one another in order to couple the at least one collector wagon to one of the press and the feeder device, and the locking bars engaging between the at least one collector wagon and the feeder device to lock the at least one collector wagon to the feeder device.

13. The combination according to claim 12, wherein the coupling guides are embodied as pairs of rails, which engage with one another, in the area of the upper edge of two walls of the at least one collector wagon located opposite one another.

14. The combination according to claim 12, wherein the coupling guides comprise guide rails guiding rollers of the at least one collector wagon, the guide rails being provided at a ground level of the press.

15. The combination according to 1, wherein the floor of the at least one collector wagon is shaped on its upper side complementary to a contour of the feeder device facing the floor.

16. The combination according to claim 1, wherein the feeder device comprises grinding teeth and a scraper, the scraper arranged at a side of the feeder device which faces the press and the scraper having a portion projecting between the grinding teeth of the feeder device, wherein the scraper removes compressible material from the feeder device.

17. The combination according to claim 1, wherein the press comprises a loading opening on its rear side for mechanically transferring the compressible material from the at least one collector wagon into the press chamber and the press encompasses, at its front side, a door, which is arranged to be pivoted into an open position, to allow removal of a pressed bale from the press chamber.

18. The combination according to claim 17, wherein a further opening is provided at the front side of the press, at a location which is one of in an upper part of the door and above the door, for receiving compressible material being manually filled into the press chamber.

19. The combination according to claim 1, wherein an active loading device of the press configured to accept and engage compressible material from the feeder device and to load the compressible material into the press chamber is arranged between the feeder device and the press chamber.

20. The combination according to claim 19, wherein the active loading device comprises at least one rotor roller having transport teeth.

21. The combination according to claim 19, wherein the feeder device, the lifting device and the active loading device are each equipped with a power demand sensor and a control unit is associated with the press, measuring signals of the power demand sensors being fed to the control unit, whereby at least one of an output of at least one of the feeder device, the lifting device and the active loading device can be changed and an operating direction of the feeder device, the lifting device and the active loading device can be reversed in accordance with the fed measuring signals.

22. The combination according to claim 20, wherein the press plate is movable in the press chamber between a position above the rotor roller and a position below the rotor roller, the transport teeth reach into the movement area of the press plate and the press plate encompasses passage slots for the transport teeth at its edge which faces the rotor roller.

23. The combination according to claim 20, wherein a bale ejector is provided in the press chamber for ejecting a pressed bale from the press chamber, from a base position outside of a movement area of the transport teeth of the rotor roller into an ejection position in the movement area of the transport teeth of the rotor roller.

* * * * *